US007210998B2

(12) United States Patent
Kazaoka et al.

(10) Patent No.: US 7,210,998 B2
(45) **Date of Patent: *May 1, 2007**

(54) ELECTRONIC GAME THAT PROVIDES MESSAGES WHEN LIMITS ARE EXCEEDED AND INHIBITS THE GAME

(75) Inventors: Koji Kazaoka, Tokyo (JP); Eiji Aida, Tokyo (JP)

(73) Assignee: Konami Corporation, Tokyo (JP)

( * ) Notice: Subject to any disclaimer, the term of this patent is extended or adjusted under 35 U.S.C. 154(b) by 338 days.

This patent is subject to a terminal disclaimer.

(21) Appl. No.: 10/106,258

(22) Filed: Mar. 27, 2002

(65) Prior Publication Data

US 2002/0142824 A1 Oct. 3, 2002

(30) Foreign Application Priority Data

Mar. 27, 2001 (JP) ..... P.2001-089572

(51) Int. Cl.
*A63F 9/24* (2006.01)

(52) U.S. Cl. ..... 463/29; 463/25; 463/16; 463/20

(58) Field of Classification Search ..... 463/24, 463/25, 29, 16, 20
See application file for complete search history.

(56) References Cited

U.S. PATENT DOCUMENTS 4,492,379 A * 1/1985 Okada ..... 273/143 R
5,429,361 A * 7/1995 Raven et al. ..... 463/25
5,902,983 A 5/1999 Crevelt et al.
6,012,983 A * 1/2000 Walker et al. ..... 463/20
6,629,890 B2 * 10/2003 Johnson ..... 463/25
2003/0190944 A1 * 10/2003 Manfredi et al. ..... 463/20

FOREIGN PATENT DOCUMENTS

| | | | |
|---|---|---|---|
| JP | 4-071583 | A | 3/1992 |
| JP | 6-63089 | | 9/1994 |
| JP | 7-299248 | | 11/1995 |
| JP | 8-287309 | A | 11/1996 |
| JP | 10-127907 | A | 5/1998 |
| JP | 10-137429 | A | 5/1998 |
| JP | 10-137443 | A | 5/1998 |
| JP | 2000-140435 | A | 5/2000 |
| KR | 0129813 | B1 | 12/1995 |
| WO | WO0032286 | * | 6/2000 |

* cited by examiner

*Primary Examiner*—Corbett B. Coburn
(74) *Attorney, Agent, or Firm*—Sughrue Mion, PLLC

(57) ABSTRACT

In a gaming machine provided with operating members actuated by human, a game processor proceeds a game in accordance with the actuation of the operating members. An inhibition requirement determinant determines whether a predetermined inhibition requirement is satisfied while the game processor proceeds the game. A game inhibiter performs game inhibition processing for diverting an attention of the player toward something other than the game, when the inhibition requirement determinant determines that the inhibition requirement is satisfied.

44 Claims, 17 Drawing Sheets

ELECTRONIC GAME THAT PROVIDES MESSAGES WHEN LIMITS ARE EXCEEDED AND INHIBITS THE GAME

BACKGROUND OF THE INVENTION

The present invention relates to a gaming machine having operating members to be actuated by a player and a game processor for proceeding a game in accordance with the nature of actuation of the operating members, and relates to a method for inhibiting a player from excessively and continuously playing a game on the gaming machine, and a computer program for executing the method.

Gaming machines of this type include a variety of types, such as home TV gaming machines, commercial gaming machines installed in amusement arcades, and slingshot machines and slot machines installed in parlors. Gaming machines which enable direct acceptance and payout of cash are installed in officially-recognized overseas gambling facilities. Since a player can indulge in playing games while being oblivious to passage of time, the gaming machines are utilized as entertainment for enjoying leisure.

However, when the player has excessively indulged in playing games, he/she loses a sense of reality. As a result, the player may continue playing games while forgetting scheduled activities or canceling the activities. Particularly, gaming machines aimed at acquiring money or prizes, so-called gambling gaming machines, often involve a player overly indulging in games, thereby resulting in the danger of the player becoming addicted to gambling. As a technique for preventing excessive indulgence in games, there have been known gaming machines which disconnect power to thereby forcibly terminate games after a player has played games for a given time period (see Japanese Utility Model Application No. 6-63089U and Japanese Patent Application No. 7-299248A).

These gaming machines forcibly terminate games merely after lapse of a given time period, regardless of the level of indulgence of a player. Mere forcible termination of games fails to cause a player to realize that he/she has overly indulged in games. Hence, the player cannot regain a sense of reality. For this reason, there is a high probability of a player resuming games on another gaming machine after forcible termination of the game, thus failing to effectively inhibit excessive gaming.

SUMMARY OF THE INVENTION

It is therefore an object of the present invention to provide a gaming machine, and a gaming inhibition method which can effectively inhibit excessive gaming, and a computer program which executes the method.

In order to achieve the above object, according to the present invention, there is provided a gaming machine, comprising:

operating members actuated by human;

a game processor, which proceeds a game in accordance with the actuation of the operating members;

an inhibition requirement determinant, which determines whether a predetermined inhibition requirement is satisfied while the game processor proceeds the game;

a game inhibiter, which performs game inhibition processing for diverting an attention of the player toward something other than the game, when the inhibition requirement determinant determines that the inhibition requirement is satisfied.

In the gaming machine, so long as the gaming inhibition requirement is set appropriately to such an extent that excessive play is prevented, the player regains a sense of reality when the gaming inhibition requirement has been satisfied. Hence, the player becomes aware that he/she has become overly indulged in games. Here, when the predetermined game inhibition requirement has been satisfied, the player undergoes game inhibition processing while the current round of game is interrupted.

Preferably, the game inhibition processing is performed while the game processor proceeds the game.

Therefore, there is no necessity of forcefully terminating a game.

Preferably, the gaming machine further comprises a presentation provider, which is activated by the game inhibition processing to provide a presentation for diverting the player's attention.

In the gaming machine, the presentation acts directly on the player for inhibiting a game.

Preferably, the gaming machine further comprises a display device, which displays a gaming image showing the game proceeded by the game processor. The game inhibiter provides an inhibition image on the display device as the game inhibition processing.

In the gaming machine, the game screen is switched to the inhibition image, thereby diverting the player's awareness to the gaming inhibition image. Thus, the player's awareness can be separated from games. Preferably, as such an inhibition image, there is employed an image, such as a TV news broadcast, which causes the player to regain a sense of reality, an image such as a warning message for prompting the player to terminate a game, and an image effective for inhibiting excessive play.

Here, it is preferable that the gaming machine further comprises an image information storage, which stores images to be displayed as the inhibition image.

In the gaming machine, as the inhibition image, there is employed an image unique to the gaming machine or an image unique to a parlor or arcade where the gaming machine is installed. Thus, there can be employed an elaborate image or an image capable of effectively inhibiting excessive play.

Alternatively, it is preferable that the gaming machine further comprises an image information receiver, which receives an externally provided image to be displayed as the inhibition image.

In the gaming machine, for example, a TV image televised at that time is displayed, thus effectively enabling the player to regain a sense of reality. In addition, there is no necessity of recording a inhibition image on the main unit, thereby reducing costs. Further, an arcade or parlor where a plurality of gaming machines are installed can collectively manage an inhibition image to be displayed by the display device.

Preferably, the game inhibiter provides an alarm as the game inhibition processing.

In the gaming machine, inhibiting effect can be exerted directly on a player who plays games excessively, thus effectively inhibiting excessive play.

Here, it is preferable that the alarm includes a visual message.

In the gaming machine, by the visual message being sent to the player, the player can understand the nature of the message readily; that is, inhibition of excessive play. Hence, the gaming machine enables the player to voluntarily stop games at his/her will.

Alternatively, it is preferable that the alarm includes a sound.

In the gaming machine, as warning is provided to the player by the sound, persons around the player know that the player is playing excessively. Hence, the player can voluntarily terminate games.

Preferably, the gaming machine further comprises a phone number register, which registers a phone number assigned to a person who is other than the player. The game inhibiter establishes a connection to a telephone having the registered phone number as the game inhibition processing.

The phone number may be entered when the player actuates the operating members or through a device which inputs a phone number of another person registered in a management system which manages the gaming machine, by way of communicators.

In the gaming machine, another person who has known that the player is playing games can persuade the player to abandon games through the phone call. Particularly, if the other person is a family member or acquaintance, the player can accept persuasion more easily from the other person rather than from the gaming machine in the form of a message or sound output. Therefore, excessive play can be effectively inhibited.

Here, it is preferable that the game inhibiter generates sounds replied from the telephone.

Another person who is informed that the player is playing games, by phone, can make a call to a portable cellular phone owned by the player or go directly to the location where the player is playing games, thereby persuading the player to stop games. However, there may be cases where difficulty is encountered in the other person persuading the player, because of a failure to establish communication with the player's portable cellular phone or because the location of the other person is distant from the location where the player is playing games.

In the gaming machine, so long as the other person talks to the player by way of his/her phone, the voice is output from the gaming machine on which the player is playing games. Hence, the other person can persuade the player without fail by way of his/her phone after having received a call from the gaming machine.

Preferably, the gaming machine further comprises an address information register, which registers address information assigned to a person who is other than the player. The game inhibiter transmits information regarding a gaming condition of the player to a communication device associated with the address information, as the game inhibition processing.

The address information may be input when the player actuates the operating members provided on the gaming machine, or through a device which inputs address information pertaining to another person registered in a management system which manages the gaming machine, by way of communicators. Alternatively, the other person can positively browse the text information.

As a result, the other person who has known that the player is playing games can persuade the player to stop playing games. Particularly, if the other person is a family member or acquaintance, the player can accept persuasion more easily from the other person rather than from the gaming machine in the form of a message or sound output. Therefore, excessive play can be effectively inhibited. The text information can be provided through an E-mail or a bulletin board on a WEB site, for example.

Here, it is preferable that the gaming machine further comprises an time information register, which registers time information indicating a time at which the player abandon the game, the time information constituting the inhibition requirement.

In the gaming machine, the player would not continue playing games while forgetting scheduled activities or canceling the activities.

Preferably, the gaming machine further comprises an ID reader, which reads out ID information of the player from a portable recording medium possessed by the player. The game inhibiter prohibits the ID reader to read out the ID information as the game inhibition processing.

In the gaming machine, when the inhibition requirement is satisfied, the player becomes unable to utilize his/her ID information. Hence, for example, the player cannot start games, use game values, or receive service. Rendering ID information unavailable provides the player with a chance of determining whether or not he or she should stop games. Thus, the awareness of the player can be diverted to something other than games.

The ID information read from the portable recording medium can be utilized for various purposes. For example, the ID information can be utilized such that the ID information is taken as a requirement for starting games, such that game value is managed on the basis of the ID information, or such that a service corresponding to a result of game is provided to a player on the basis of the ID information.

Preferably, the gaming machine further comprises a canceller, which cancels the game inhibition processing.

The canceller may be set to function or not to function in accordance with the player's operation. In the former case, the canceller can be constructed so as to operate in accordance with an attendant at a parlor or arcade where the gaming machine is installed. In this case, the attendant cancels the gaming inhibition processing after a player has given up games because of the gaming inhibition processing, whereby another player can use the gaming machine. In the latter case, in light of a difference between players in what constitutes excessive play, excessive enforcement of inhibition of games to a player who can still continue games can be prevented.

Preferably, the gaming machine further comprises a game number counter, which counts a number of game executed by the game processor from a predetermined time point. The inhibition requirement is satisfied when the number counted by the game number counter reaches a predetermined number.

In the gaming machine, so long as the number of games is taken as an object of determination in connection with the inhibition requirement, the player can be inhibited from spending money for games by setting a predetermined number of games, as required.

Here, the predetermined time point is a time point at which a player starts playing games. However, the predetermined time point may be another time point, such as an arbitrary time point during the course of the player playing games. Preferably, the predetermined reference time is set individually for each player for inhibiting each player from excessively playing games.

As a method of determining such a time point, there is a conceivable method of taking, as the predetermined time point, a time point at which each player performs operation required for starting games or a time point at which a player presses a button at his/her will.

Preferably, the gaming machine further comprises a timer which measures a time period from a predetermined time point. The inhibition requirement is satisfied when the time period measured by the timer reaches a predetermined time period.

In the gaming machine, if the elapsed time is taken as an object of determination in connection with the inhibition requirement, the player can be inhibited from continuously playing games by setting a predetermined time period of time, as required. The predetermined time period is the same as that described previously.

Preferably, the gaming machine further comprises: a gaming value accepter, which accepts a gaming value from a player; and a gaming value counter, which counts an amount of gaming value accepted by the gaming value accepter, from a predetermined time point. The inhibition requirement is satisfied when the amount of gaming value counted by the gaming value counter reaches a predetermined amount.

Here, the expression "gaming value" means values to be paid by a player into a gaming machine for playing games. The gaming value includes medals, tokens, or coins (or bills). Further, the expression "gaming value" includes tangible substances or intangible substance equivalent to the tangible substances, such as electronic data.

In the gaming machine, if the amount of gaming value is taken as an object of determination in connection with an inhibition requirement, the player can be directly inhibited from spending money for games by setting the amount of gaming value, as required. The predetermined time period is the same as that described previously.

Preferably, the gaming machine further comprises: a gaming value accepter, which accepts a gaming value from a player; and a gaming value storage, which stores an amount of gaming value accepted by the gaming value accepter. The inhibition requirement is satisfied when the stored amount of gaming value is consumed in the game.

In relation to the gaming machine by which a player plays games through use of gaming values recorded in the gaming machine, when the recorded gaming values have become depleted, the player newly borrows gaming tokens serving as gaming values and inserts the thus-borrowed gaming tokens. Alternatively, the player inserts money serving as gaming values newly into the gaming machine or selects a game end.

In the gaming machine, it is possible to divert the player's awareness to something other than games at a timing for selection. Hence, it is possible to effectively prompt the player to select a game end.

Preferably, the gaming machine further comprises a payout provider, which provides a payout to the player, the payout being a gaming value corresponding to a result of the game. The inhibition requirement is satisfied when an amount of the payout at one unit of the game reaches a predetermined amount.

There are usually many cases in which the player determines whether to terminate games after having hit a big bonus and acquired a large amount of gaming values. In the gaming machine, the player's awareness can be diverted to something other than games at a timing at which a big bonus has hit, thus effectively leading the awareness of the player toward termination of a game.

Preferably, the game includes a basic game and a special game activated by the game processor in accordance with a result of the basic game. The inhibition requirement is satisfied when the special game is finished.

Here, the special game means a game which differs from an ordinary game status and arises at the time of a feature game or a bonus game. In many cases, a player determines whether to end a game after having played the special game. The gaming machine diverts the player's awareness to something other than games at a timing just after such a special game has ended. Hence, the player's will can be effectively led to termination of a game.

Preferably, the inhibition requirement includes a plurality of sub-requirements. The game inhibiter performs the game inhibition processing when at least one of the sub-requirements is satisfied.

In the gaming machine, an appropriate combination of the plurality of sub-requirements enables performance of gaming inhibition processing at appropriate timings for a variety of players.

Here, it is preferable that the gaming machine further comprises a resetter, which resets at least one of conditions associated with the respective sub-requirements when the at least one of the sub-requirements is satisfied.

In the gaming machine, when another player starts playing games on the gaming machine after a preceding player has finished playing games through the game inhibition processing, an inhibition requirement can be determined for the latter player again from the beginning.

Preferably, the inhibition requirement is determined in accordance with information which is externally input by the player.

In general, a player keeps in mind a potential risk of becoming overly indulged in games before being enthusiastically involved in games. The gaming machine heeds the player's autonomy and enables a player to set an inhibition requirement at his/her will. In the case of a predetermined inhibition requirement, a player may feel that he/she is forced to stop games by others. If the player determines his/her own inhibition requirement, the player will not have such a feeling. Moreover, the player can finish games at a timing suitable for the player. Hence, the player can finish games with satisfaction.

In order to attain the above advantages, according to the present invention, there is also provided a method of inhibiting a player to excessively play a game performed in a gaming machine, comprising the steps of:

proceeding the game on the gaming machine;

determining whether a predetermined inhibition requirement is satisfied while the game is proceeded; and diverting an attention of the player toward something other than the game, when the inhibition requirement is satisfied.

Preferably, the game proceeding step includes a step of displaying a gaming image on a display device. The attention diverting step includes a step of displaying an inhibition image on the display device.

Here, it is preferable that the method further comprises the steps of: storing images in an image information storage; and reading out an image to be displayed as the inhibition image from the image information storage.

Alternatively, it is preferable that the method further comprises the step of receiving an externally provided image to be displayed as the inhibition image.

Preferably, the attention diverting step includes the step of providing an alarm. Here, it is preferable that the alarm includes a visual message. Alternatively, it is preferable that the alarm includes a sound.

Preferably, the method further comprises the step of registering a phone number assigned to a person who is other than the player. The attention diverting step includes the step of establishing a connection to a telephone having the registered phone number as the game inhibition processing.

Here, it is preferable that the attention diverting step includes the step of generating sounds replied from the telephone.

Alternatively, it is preferable that the method further comprises the step of registering address information assigned to a person who is other than the player. The attention diverting step includes the step of transmitting information regarding a gaming condition of the player to a communication device associated with the address information.

Here, it is preferable that the method further comprises the step of registering time information indicating a time at which the player abandon the game, the time information constituting the inhibition requirement.

Preferably, the method further comprises the step of reading out ID information of the player from a portable recording medium possessed by the player. The attention diverting step includes the step of prohibiting the ID reader to read out the ID information.

Preferably, the method further comprises the step of counting a number of game executed by the game processor from a predetermined time point. The inhibition requirement is satisfied when the counted reaches a predetermined number.

Preferably, the method further comprises the step of measuring a time period from a predetermined time point. The inhibition requirement is satisfied when the measured time period reaches a predetermined time period.

Preferably, the method further comprises the steps of: accepting a gaming value from a player; and counting an amount of gaming value accepted by the gaming value accepter, from a predetermined time point. The inhibition requirement is satisfied when the counted amount of gaming value reaches a predetermined amount.

Preferably, the method further comprises the steps of: accepting a gaming value from a player; and storing the accepted amount of gaming value. The inhibition requirement is satisfied when the stored amount of gaming value is consumed in the game.

Preferably, the method further comprises the step of providing a payout to the player, the payout being a gaming value corresponding to a result of the game. The inhibition requirement is satisfied when an amount of the payout at one unit of the game reaches a predetermined amount.

Preferably, the game proceeding step includes the steps of: executing a basic game; and activating a special game in accordance with a result of the basic game. The inhibition requirement is satisfied when the special game is finished.

Preferably, the inhibition requirement includes a plurality of sub-requirements. The attention diverting step is performed when at least one of the sub-requirements is satisfied.

Here, it is preferable that the method further comprises the step of resetting at least one of conditions associated with the respective sub-requirements, when the at least one of the sub-requirements is satisfied.

Preferably, the method further comprises the step of determining the inhibition requirement in accordance with information which is externally input by the player.

In order to attain the above advantages, according to the present invention, there is also provided a program for causing a computer to execute the above game inhibition method.

The program is distributed or available while recorded on a recording medium, such as a CD-ROM. So long as a program is superimposed on a signal and the signal is transmitted or received by a predetermined transmitter by way of a public phone line, a private line, or a transmission medium, such as another communication network, the program can be distributed and acquired. The only requirement is that at least a portion of the program be transmitted over the transmission medium during the course of transmission. In short, there is no necessity for all the data constituting the program being temporarily located in the transmission medium. A signal having the program superimposed thereon is a computer data signal embodied in a predetermined carrier wave including a program. Further, a method of transmitting a program from a predetermined transmitter includes a case where data constituting a program are transmitted continuously and a case where the data are transmitted intermittently.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

There will now be described a first embodiment in which the present invention is applied to a slot machine or a symbol-match gaming machine. A slot machine to be described in the present embodiment is a video slot machine installed in a casino or the like.

The basic configuration of a slot machine according to the present embodiment will now be described.

Figure 2:
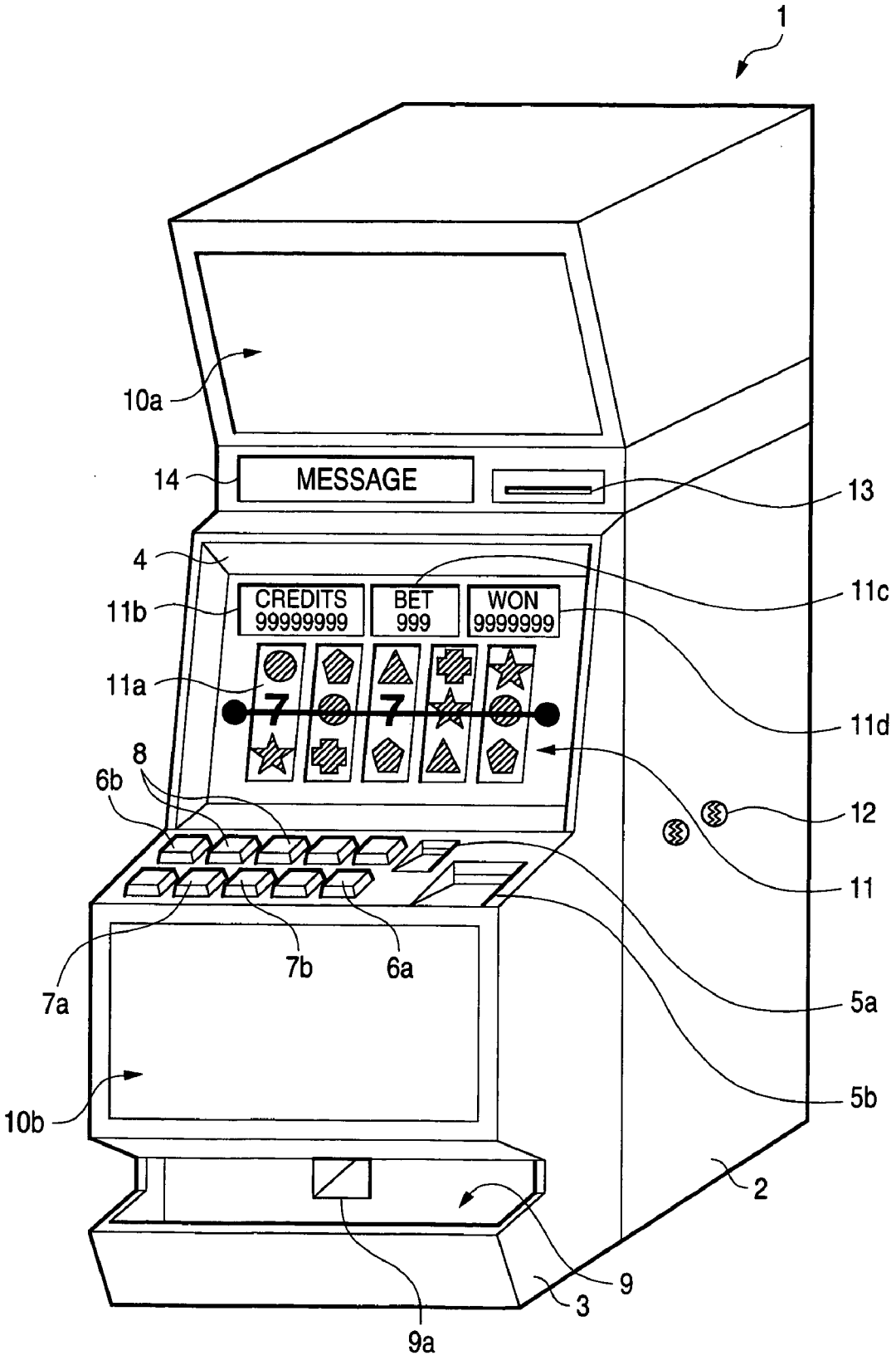
FIG. 2 is an external perspective view of the slot machine.

FIG. 2 is an external perspective view of a slot machine according to the first embodiment. The slot machine 1 has a box-shaped housing 2 and a front panel 3 reclosably attached to a front side of the housing 2. The front panel 3 has a display window 4 for visually viewing, from the outside, a monitor 11 serving as a variable game screen display; a coin insertion slot 5*a* and a bill insertion slot 5*b* constituting a gaming value accepter; a play button 6*a* serving as a game starter; a reimbursement button 6*b* serving as a payout requester; BET buttons 7*a* and 7*b* used by a player to insert coins into a slot machine; a coin receiver 9 having a coin refund port 9*a;* and lamps 10*a* and 10*b* serving as a light emitter. The play button 6*a,* the credit reimbursement button 6*b,* the BET buttons 7*a* and 7*b,* and the other operation button 8 are embodied as lamp buttons equipped with light emitters.

The monitor 11 for displaying five reel images (play screens) 11*a,* on which a plurality of types of symbols sequentially appear, is provided in the slot machine 1. The monitor 11 is composed of a CRT display but may be constituted of a plasma display or a liquid-crystal display. In a position located above the reel images 11*a* of the monitor 11 are displayed a credit display section 11*b* for displaying the sum of credit equivalent to the amount of money, or gaming values, inserted by the player by way of the coin insert slot 5*a* or the bill insertion slot 5*b;* a BET display section 11*c* for displaying the amount of bets placed by the player by actuation of the BET buttons 7*a* and 7*b;* and an acquired amount display section 11*d* for displaying the amount of money acquired by the player as a result of a game.

Built into the slot machine 1 are an inspection apparatus for checking whether or not accepted coins or bills are genuine, an unillustrated coin refunding device having a hopper capable of receiving a plurality of coins, a speaker serving as a sound generator or a presentation sound generator, and a circuit board in which an electronic circuit is formed from electronic components, such as a CPU, ROM, or other electronic components to constitute a controller.

A reset button 12 serving as a game inhibition releaser is provided on the side of the slot machine 1. The reset switch 12 has a keyway corresponding to a specialized key possessed by an attendant of the casino where the slot machine 1 is installed. The reset switch 12 is actuated by inserting the specialized key into the keyway. Thus, a player cannot actuate the reset switch 12.

A card insertion slot 13 for enabling insertion of a house card serving as a portable recording medium to be used in a casino and a display device 14 are provided in an upper section of the slot machine 1. The house card is for managing personal information about a player registered at a reception desk of the casino. The house card has recorded thereon an ID, which is identification information unique to an individual player. A casino management system manages personal information about each player in association with an ID. The house card is utilized for the management system to manage points corresponding to the amount of money spent by the player in the games. In accordance with points owned, a bonus, such as a free hotel coupon, can be afforded to a player. The display device displays points owned by the player.

Figure 3:
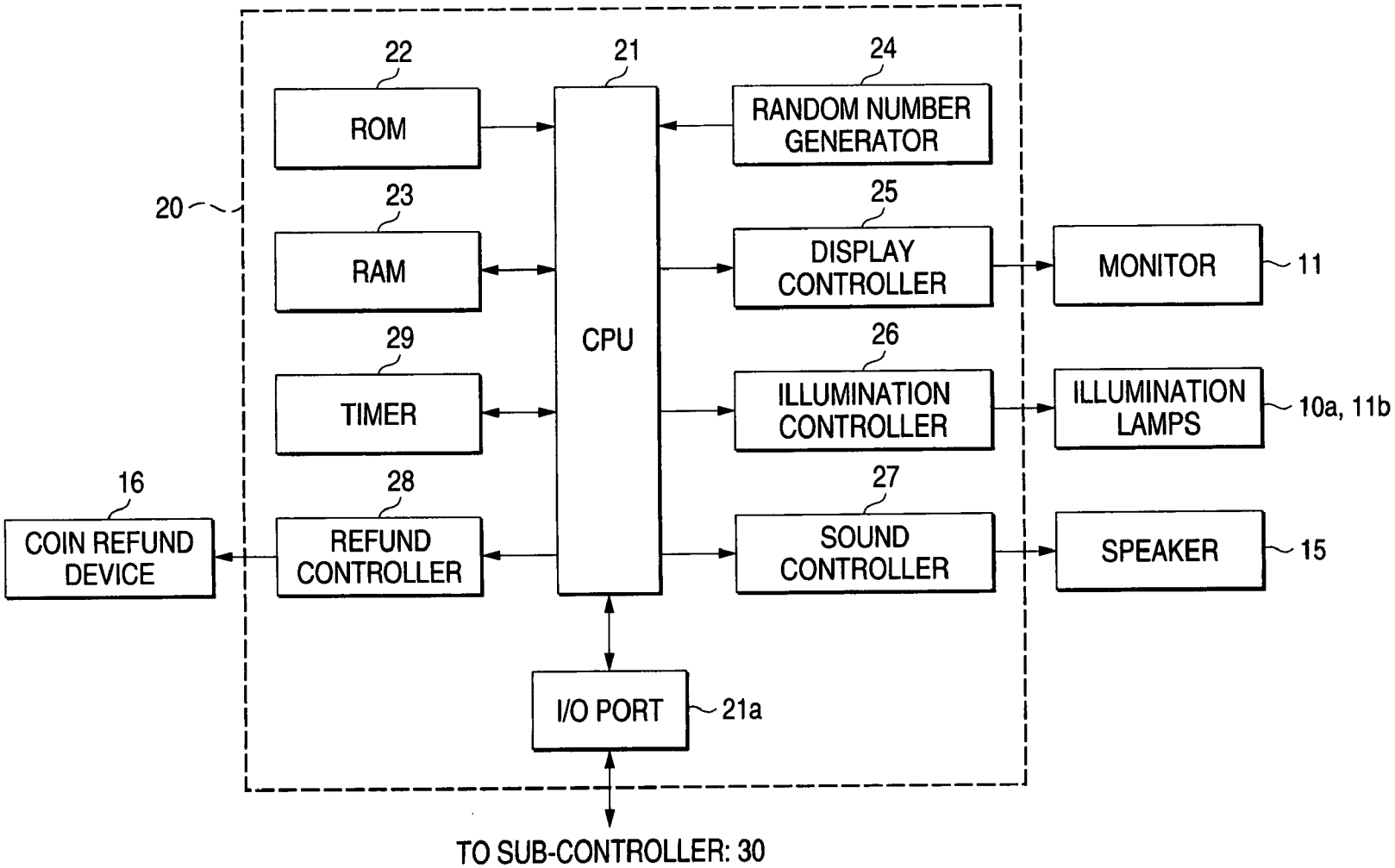
FIG. 3 is a block diagram schematically showing the configuration of a main controller of the slot machine.
Figure 4:
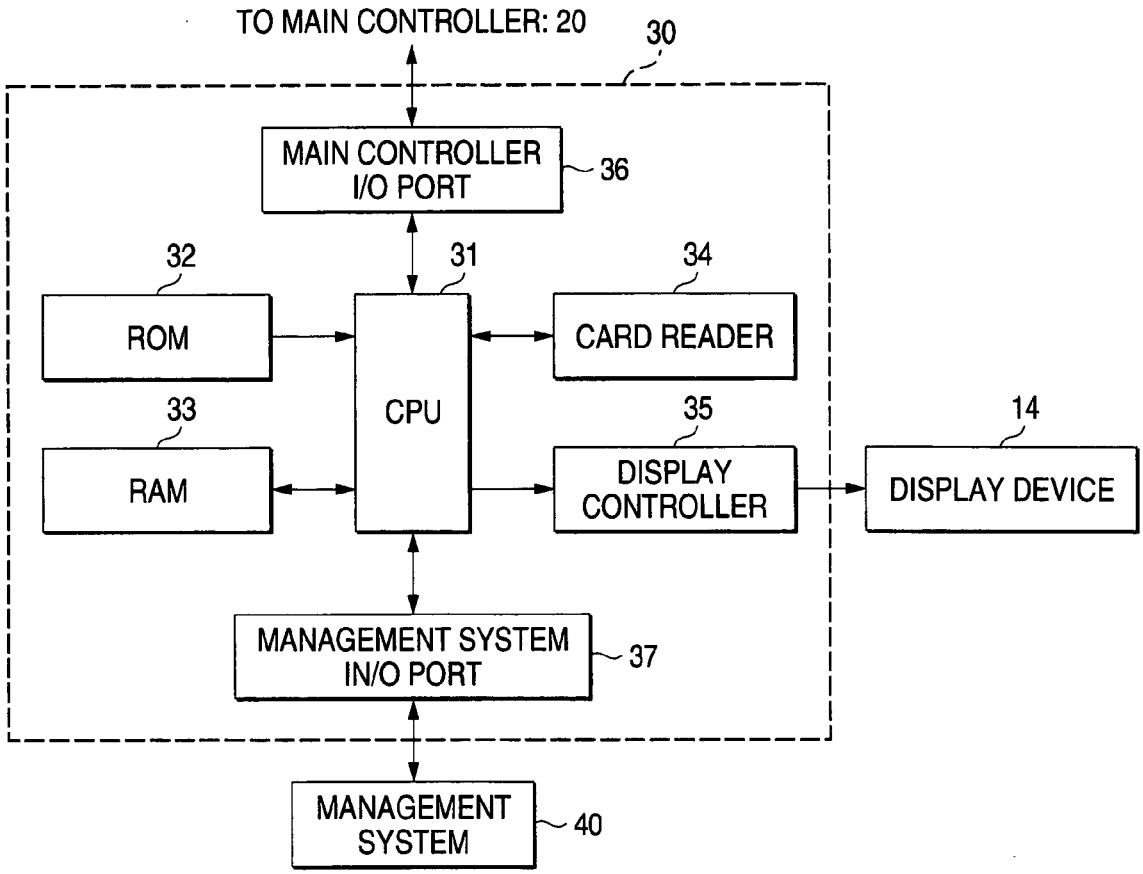
FIG. 4 is a block diagram schematically showing the configuration of a sub-controller of the slot machine.

FIG. 3 is a block diagram schematically showing the configuration of a main controller 20 in the controller of the slot machine 1. FIG. 4 is a block diagram schematically showing the configuration of a sub-controller 30 which constitutes the controller together with the main controller 20.

The main controller 20 comprises a CPU 21, an I/O port 21*a,* ROM 22, RAM 23, a random number generator 24, a display controller 25, an illumination controller 26, a sound controller 27, a refund controller 28, and a timer 29. The I/O port 21*a* is utilized for establishing data communication with the sub-controller 30. The ROM 22 stores data to be utilized by the CPU 21, such as various programs and databases, and outputs the data to the CPU 21. The RAM 23 temporarily stores variable-number data computed by the CPU 21. The random number generator 24 produces a random number at a predetermined cycle and outputs to the CPU 21 data pertaining to the thus-produced random number. Under control of the CPU 21, the display controller 25 controls displaying operation of the monitor 11 which displays the reel images 11*a*. Under control of the CPU 21, the illumination controller 26 controls illumination of the lamps 10*a* and 10*b*. Under control of the CPU 21, the sound controller 27 controls a voice announcement or presentation sound output from a speaker 15. Under control of the CPU 21, the refund controller 28 controls the coin refund device 16 serving as a payout provider for refunding coins to the coin receiver 9 by way of the coin refund port 9*a*. Under control of the CPU 21, the timer 29 measures a time period and outputs a measurement result to the CPU 21.

The CPU 21 of the main controller 20 is connected to the play button 6*i a,* the credit reimbursement button 6*b,* the BET buttons 7*a* and 7*b,* and the other operation buttons 8. The CPU 21 is connected also to an money counter serving as an unillustrated gaming value counter for counting coins inserted by way of the coin insertion slot 5*a* or a bill inserted by way of the bill insertion slot 5*b*.

The sub-controller 30 is constituted of a CPU 31, a ROM 32, a RAM 33, a card reader 34 serving as an identification information reader, a display controller 35, a main controller I/O port 36, and a management system I/O port 37. The ROM 32 stores data to be utilized by the CPU 31, such as programs or databases, and outputs the data to the CPU 31. The RAM 33 temporarily stores variable-number data computed by the CPU 31. The card reader 34 reads an ID recorded on a house card inserted by way of the card insertion slot 13. The thus-read ID is output to the CPU 31. Under the control of the CPU 31, the display controller 35 controls display operation of the display device 14. The main controller I/O port 36 is utilized for establishing data communication with the main controller 20. The management system I/O port 37 is utilized for establishing data communication with a management system 40 which collectively manages a plurality of gaming machines installed in a casino.

In accordance with flow of a game performed by the slot machine 1, operations of individual sections will be described.

When a player inserts unillustrated coins into the coin insertion slot 5*a* or a bill into the bill insertion slot 5*b*, the unillustrated money counter counts the coins or bill. The money counter outputs inserted amount data to the CPU 21 of the main controller 20. The CPU 21 that has received inserted amount data acts as a gaming value recorder and records credit data (gaming value) corresponding to the inserted amount data into the RAM 23 serving as a gaming value recording medium.

When having decided a desired amount to bet, the player actuates the predetermined BET buttons 7*a* and 7*b*. Data pertaining to the actuation of the BET buttons 7*a* and 7*b* are sent as a predetermined operation signal to the CPU 21 of the main controller 20. The CPU 21 performs processing for decreasing from credit data stored in the RAM 23 credits corresponding to the operation signal. The CPU 21 becomes able to accept an operation signal from the play button 6*a*, thus rendering operation of the play button 6*a* performed by the player effective.

When the player has actuated the play button 6*a*, a result of operation is sent to the CPU 21 of the main controller 20 as an operation signal. Having received the operation signal, the CPU 21 acts as a game processor. First, the CPU 21 receives five sets of data pertaining to random numbers sent from the random number generator 24. The random numbers correspond to the respective reel images 11*a* appearing on the monitor 11. The CPU 21 checks the random numbers against a symbol table stored in the ROM 22. The symbol table is provided for each of the reel images 11*a*. The CPU 21 outputs to the display controller 25 the random numbers and displayed symbol data acquired from the respective symbol tables. As a result, after having displayed on the monitor 11 reel images whose symbols are variably displayed, the display controller 25 performs display control operation for stopping, at the corresponding reel images, symbols corresponding to the respective displayed symbol data sent from the CPU 21.

The CPU 21 performs winning determination processing for checking a combination of five random numbers sent from the random number generator 24 against a winning determination table stored in the ROM 22. The winning determination table is used for associating a combination of five random numbers with a winning combination. As winning combinations, there are prepared a combination for paying off a predetermined amount of credits to the player, and a combination for shifting the current round of game to a special game status, such as an event, a bonus game, or a feature game. By reference to a combination of random numbers and a winning determination table, the CPU 21 specifies a winning combination hit in the present round of game or a failure when no winning combination is constituted.

When a winning combination for paying a predetermined amount of credit to a player is determined to have hit through the winning determination processing, after the reel images 11*a* appearing on the monitor 11 have been stopped, the CPU 21 of the main controller 20 outputs a predetermined presentation signal to the illumination controller 26 and the sound controller 27. As a result, the illumination controller 26 performs illumination control operation for causing the lamps 10*a* and 10*b*, the spin button 6*a*, the BET buttons 7*a*, 7*b*, and a lamp button equipped with the light emitter among the other operation buttons 8, all remaining in an illuminated state, to blink in a blink pattern corresponding to the presentation signal. The sound controller 27 performs control operation for temporarily suspending sound output from the speaker 15 as presentation sound and causing the speaker 15 to output a sound effect corresponding to a presentation signal. The CPU 21 acts as a gaming value payout provider to perform payout operation for adding to the credit data recorded in the RAM 23 credit corresponding to the winning combination.

When a winning combination for shifting the current round of game to an event, a bonus game, or a feature game is determined to have hit through the winning determination processing, after the reel images 11*a* appearing on the monitor 11 have been stopped, the CPU 21 of the main controller 20 outputs a predetermined presentation signal to the illumination controller 26 and the sound controller 27. As a result, the illumination controller 26 performs illumination control operation for causing the lamps 10*a* and 10*b*, all remaining in an illuminated state, to blink in a blink pattern corresponding to the presentation signal. Further, the sound controller 27 performs control operation for temporarily suspending sound output from the speaker 15 as presentation sound and causing the speaker 15 to output a sound effect corresponding to a presentation signal. The CPU 21 acts as a game status changer for changing the current mode of game; i.e., a general game status, to a special game status such as an event or bonus game corresponding to a winning combination.

The slot machine 1 according to the present embodiment converts the credit spent by the player into points and provides various services to the player in accordance with the points. The player who desires to receive the service registers at the reception desk of the casino, where the slot machine 1 is installed, before playing a game on the slot machine 1. Through the registration processing, personal information; e.g., the name and address of a player, is filled into a predetermined form. The player receives a house card having printed thereon an ID unique to the player. The personal information filled in the form is registered into the database stored in the management system 40 by way of a predetermined terminal.

The player who has received the house card in this way inserts the house card into the card insertion slot 13 before commencing a game on the slot machine 1. The card reader 34 of the sub-controller 30 reads an ID recorded on the thus-inserted house card. The thus-read ID is sent to the CPU 31. The CPU 31 sends to the management system 40 the ID that has been received from the card reader 34, by way of the management system I/O port 37, thereby receiving point data pertaining to the ID. A player who utilizes a house card for the first time receives point data of "0." In contrast, a player who has utilized the house card in the past receives the point data stored through the games played in the past. After having temporarily stored the point data into the RAM 33, the CPU 31 that has received the point data outputs to the display controller 35 a display instruction corresponding to the point data. The display controller 35 performs display control operation for displaying the point as character information on the display device 14.

Every time the player plays a game on the slot machine 1, the CPU 21 of the main controller 20 outputs, to the sub-controller 30 by way of the I/O port 21*a*, credit consumption data pertaining to the amount of credit recorded in the RAM 23. The credit consumption data are input to the CPU 31 by way of the main controller I/O port 36 of the sub-controller 30. As a result, the CPU 31 converts the credit consumption data into points and adds the points to the point data stored in the RAM 33. The point data to which the points have been added are displayed on the display device 14 at all times. By way of the management system I/O port 37, the CPU 31 outputs data corresponding to the points to the management system 40 along with the ID. Having received the point data, the management system 40 adds the point data to the point data registered in the database in association with the ID.

The point data which are registered in the database of the management system 40 in this manner can be converted into a service corresponding to the points at the reception desk of the casino at the player's wishes.

Figure 1:
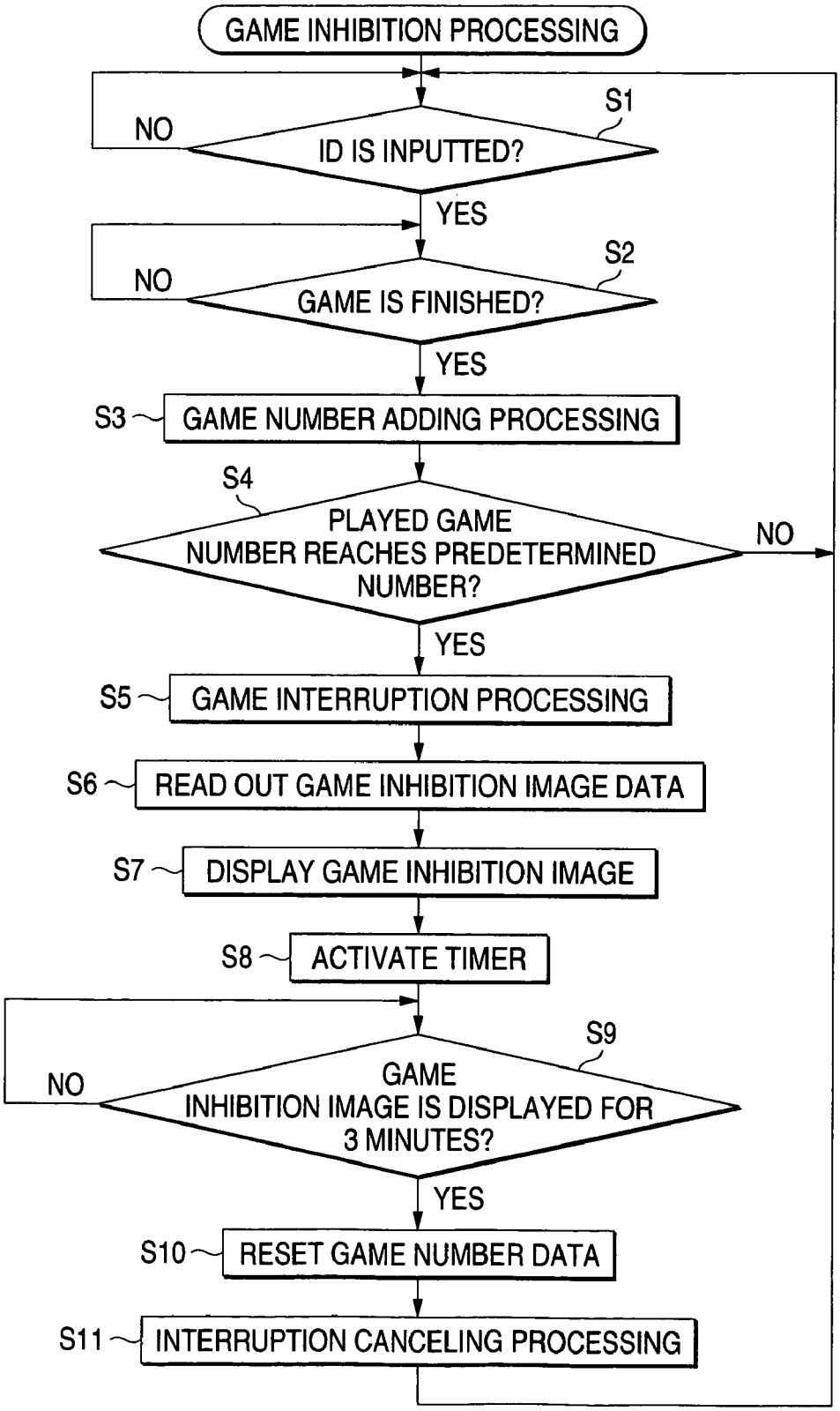
FIG. 1 is a flowchart showing flow of excessive gaming inhibition processing to be performed in a slot machine according to a first embodiment of the present invention.

Operation for inhibiting excessive gaming of a player will now be described. FIG. 1 is a flowchart showing the flow of operation for inhibiting excessive play according to the present embodiment.

First, when a player inserts his/her house card into the card insertion slot 13, the ID read by the card reader 34 is input to the CPU 21 of the main controller 20 for each game (S1). The time when the house card is inserted into the card insertion slot 13 is taken as a predetermined reference time, and game inhibition processing is started. The CPU 21 acts as a game number counter. When a game is completed as a result of the reel images 11*a* appearing on the monitor 11 having stopped (S2), the CPU 21 performs game number addition processing for adding "1" to the game number data recorded on the RAM 23 (S3). After having performed the game number addition processing in each game, the CPU 21 acts as an inhibition requirement determinant. The CPU 21 determines whether or not the number of games A pertaining to the game number data has reached a preset number of times (i.e., a predetermined number of times) B (S4). When the number of games A is determined not to have reached the specified number of times B through the determination processing pertaining to step S4, processing then returns to step S1. The next game is performed in the same manner. In contrast, when the number of games A is determined to have reached the specified number of times B, the CPU 21 acts as a game inhibiter together with the display controller 25, thereby performing game inhibition processing.

First, the CPU 21 acts as a game interrupter or an operation canceller through the game inhibition processing according to the present embodiment, thereby performing gaming interruption processing (S5). As a result, the CPU 21 becomes unable to receive an operation signal output from the play button 6*a*. As a result, the player cannot start a game even by actuating the play button 6*a*. The CPU 21 outputs an acceptance refusal instruction to the unillustrated money counter, thereby causing the money counter to act as an acceptance refuser. Thus, counting of inserted coins or bill is nullified. Even when the player inserts a coin by way of the coin insertion slot 5*a*, the thus-inserted coin is not counted as a credit and is refunded by way of the coin receiver 9. Further, in the same manner, even when a bill is inserted by way of the bill insertion slot 5*b*, the thus-inserted bill is not counted as a credit. Hence, the bill is refunded by way of the bill insertion slot 5*b*.

Until the interruption is canceled, the CPU 21 of the main controller 20 remains able to accept an operation signal output from the credit reimbursement button 6*b*. Hence, if the player actuates the credit reimbursement button 6*b* during the course of a game being interrupted, the CPU 21 receives the operation and outputs a refund instruction to the refund controller 28 along with the credit amount data recorded in the RAM 23. As a result, the refund controller 28 controls the coin refund device 16, thereby ejecting coins corresponding to the received credit amount data to the coin receiver 9 by way of the coin payout port 9*a*.

The CPU 21 of the main controller 20 loads game inhibition image data stored in the ROM 22 (S6). The game inhibition image data are sent to the display controller 25 as a game inhibition image display controller. The display controller 25 converts the game inhibition image based on the game inhibition image data into reel images 11*a* and displays the game inhibition image on the monitor 11 in lieu of the reel images 11*a* (S7). As a result, the game inhibition image appears in the area on the monitor 11 where the reel images 11*a* have been displayed. The game inhibition image may be a stationary or moving image which can cause the player to divert his/her consciousness to anything other than a game. Preferably, the game inhibition image can lead the player to terminate the game.

As a game inhibition image to be displayed on the monitor 11, a moving image, such as a motion picture, or a stationary image, such as a photograph of nature, may be employed. If an attempt is made to actively stop the player who is excessively playing games, a game inhibition message for inhibiting the player from playing games may be may be reported to player as an alarm. In this case, for example, a warning message about excessive play is displayed on the monitor 11 serving as a game inhibition message provider, in place of the game inhibition image of a motion picture. A statement certified by a public organization relating to inhibition of excessive play may be used as a warning message. Displaying a seal of the public organization along with the warning message is likely to be effective.

In the present embodiment, displaying a game inhibition image on the monitor 11 enables separation of the consciousness of the player from games, thereby inhibiting excessive play. In addition to a method of visually inhibiting excessive play, there may also be utilized a method of audibly separating the consciousness of the player from games, thereby inhibiting excessive play. For example, sound information about a warning announcement is recorded on the ROM 22 of the main controller 20. Under control of the CPU 21, which performs game inhibition processing, the sound controller 27 may outputs the warning announcement from the speaker 15. In this case, the warning announcement may be heard by other players playing on gaming machines installed around the slot machine 1, casino attendants, and other persons. Hence, this method is very effective for inhibiting the player who is playing games excessively from continuing games. In place of the warning announcement, warning sound or music may be output.

In the present embodiment, when display of the game inhibition image is started through the game inhibition processing, the timer 29 of the main controller 20 starts measuring a time period during which the game inhibition image is displayed (S8). The CPU 21 of the main controller 20 determines whether or not an interruption cancellation requirement; that is, the display time period measured by the timer 29 having reached three minutes, is achieved (S9). When it is determined that the display time period has reached three minutes, the CPU 21 resets the game number data recorded in the RAM 23 to "0" (S10). Further, the CPU 21 becomes able to accept an operation signal output from the play button 6*a* and outputs an acceptance enable instruction to the unillustrated money counter. As a result, the slot machine 1 returns to a status that had been effective before the game was interrupted (S11).

In the present embodiment, the display time period employed as an interrupt cancellation requirement is three minutes. However, the time may be set in accordance with a time during which a game inhibition image is displayed or with the contents of the image, as required. When a warning message or announcement is issued to a player, it is desirable to ensure a time during which the player can sufficiently understand the nature of the warning upon receipt of the warning message or announcement.

In the present embodiment, the number of games is counted while the time at which a house card is inserted is taken as a reference time. However, in the case of the slot machine 1 which enables a player to play games without utilization of a house card, the slot machine 1 cannot inhibit a player who does not have any house card from playing games excessively. In this case, a game inhibition start button to be actuated by a player before the player starts playing games may be provided on the slot machine 1. In this case, on the basis of autonomy of a player who keeps in mind a potential risk of excessively indulging in games, the player actuates the game inhibition start button before becoming involved in games. The time at which the button has been actuated may be taken as a reference time.

In the present embodiment, when a specified number of games have ended after the player has started playing games by utilization of a house card, a game inhibition image appears on the monitor 11. The consciousness of the player who is enthusiastically playing games concentrates on the game inhibition image upon glancing the image and can recover the sense of reality. Thus, the player successfully regains self-control, and hence it is possible to prompt the player to stop games.

The above embodiment has described a case where game inhibition processing is performed when the number of games A has reached a specified number of times B. There will now be described a second embodiment of the invention utilizing a play time period C in place of the number of games A. The present embodiment is identical with the first embodiment, except that the play time period C is utilized in place of the number of games A. Only a unique portion of this embodiment will now be described.

Figure 5:
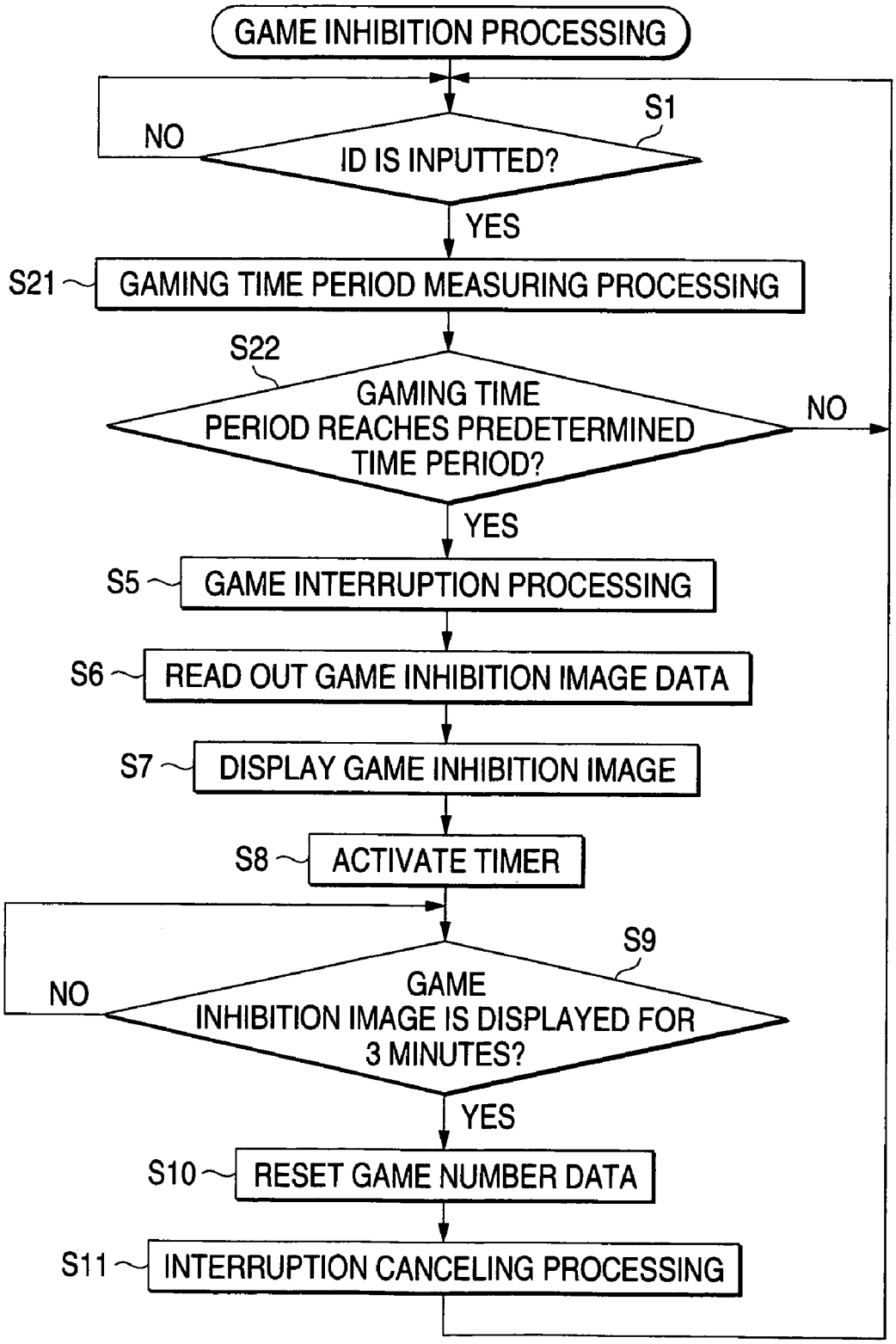
FIG. 5 is a flowchart showing flow of excessive gaming inhibition processing according to a second embodiment of the invention.

FIG. 5 is a flowchart showing the flow of excessive gaming inhibition processing according to this embodiment.

The player inserts a house card into the card inset slot 13, and the ID read by the card reader 34 is input to the CPU 21 of the main controller 20 (S1). The CPU 21 performs processing for measuring a time period in which the game is played (S21). Through the processing, a measurement instruction for measuring a specified time period is output to the timer 29. The timer 29 measures a time which elapses until a specified time period is achieved since the timer received the measurement instruction. When a specified time period D has been achieved, the timer 29 outputs a measurement end signal to the CPU 21. The CPU 21 acts as an inhibition requirement determinant. Upon receipt of the measurement end signal from the timer 29, the CPU 21 determines that a game inhibition requirement; that is, the play time period C having achieved the specified time period D, is satisfied (S22). After the play time period C is determined to have reached a preset specified time period (predetermined time) D, the CPU 21 performs the gaming interruption processing in the same manner as in the first embodiment (S5) and performs the game inhibition processing (S6).

Next will be described a third embodiment of the invention utilizing an amount of consumed credit E in place of the number of games A. The present embodiment is identical with the first embodiment, except for utilization of the amount of consumed credit E in lieu of the number of games A. Hence, only a unique feature of this embodiment will be described.

Figure 6:
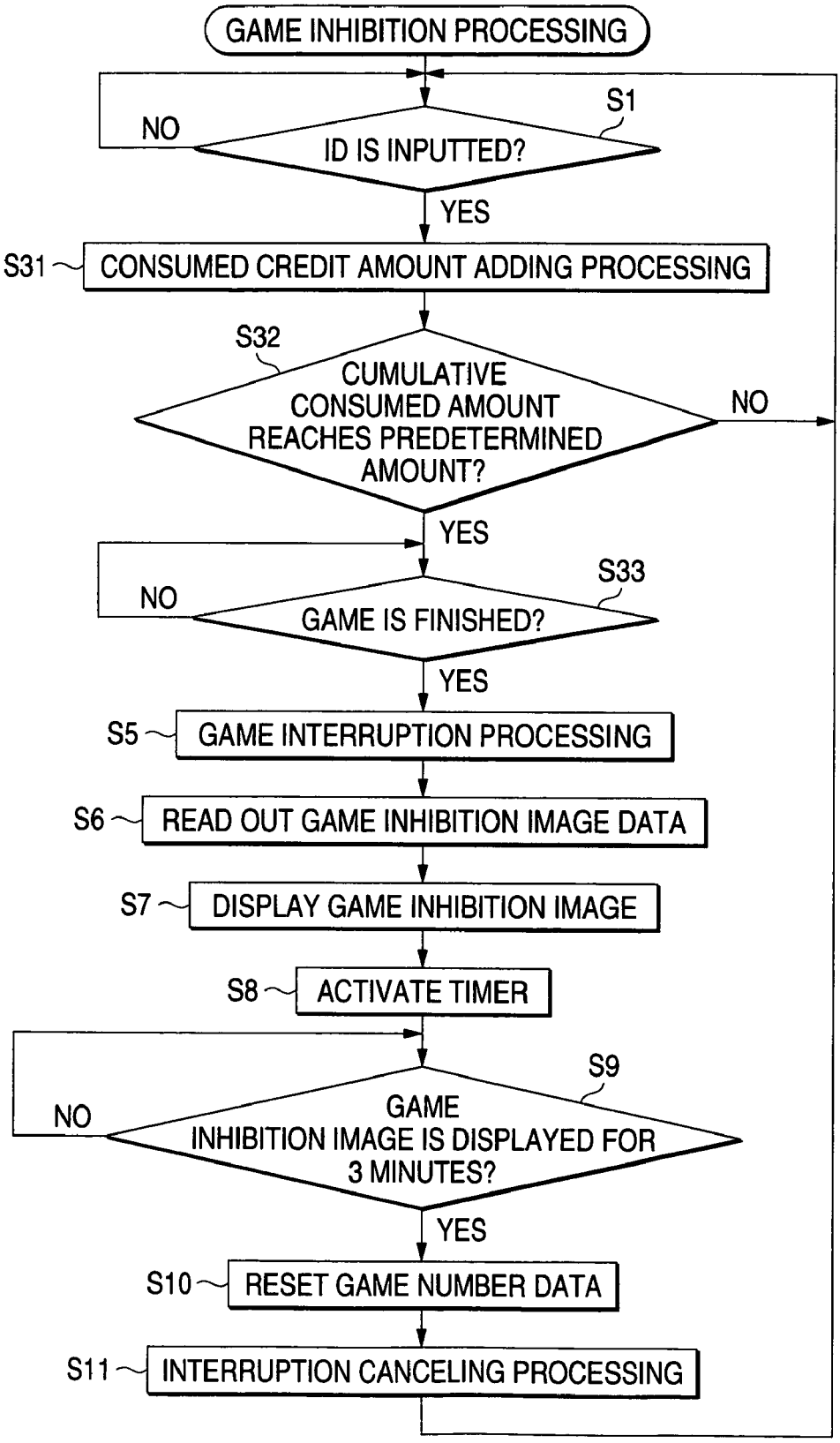
FIG. 6 is a flowchart showing flow of excessive gaming inhibition processing according to a third embodiment of the invention.

FIG. 6 is a flowchart showing the flow of excessive gaming inhibition processing according to this embodiment.

As mentioned above, every time a player plays a game on the slot machine 1, the CPU 21 of the main controller 20 sends, to the management system 40 by way of the sub-controller 30, credit consumption data pertaining to the amount of consumed credit recorded in the RAM 23, thereby performing point addition processing. In this embodiment, the player inserts a house card into the card insertion slot 13, and the ID read by the card reader 34 is input to the CPU 21 of the main controller 20 (S1). Then, the CPU 21 outputs credit consumption data to the sub-controller 30, thereby performing credit consumption addition processing for cumulatively adding the credit consumption data to the RAM 23 (S31). After having performed credit consumption addition processing in each game, the CPU 21 acts as an inhibition requirement determinant. The CPU 21 then determines whether or not a game inhibition requirement; that is, a cumulatively consumed amount E of the accumulated credit consumption data having reached a preset specified amount (predetermined amount) F, has been satisfied (S32). If the cumulatively consumed amount E is determined to have reached the specified amount F, the CPU 21 performs gaming interruption processing (S5) after having ended the game (S33), and then performs game inhibition processing (S6).

Next will be described a fourth embodiment of the invention in which gaming inhibition processing is performed when credits of a player have been depleted. The present embodiment is identical with the first embodiment, except that depletion of credits is employed as a requirement for inhibiting gaming. Hence, only a feature particular to this embodiment will be described.

Figure 7:
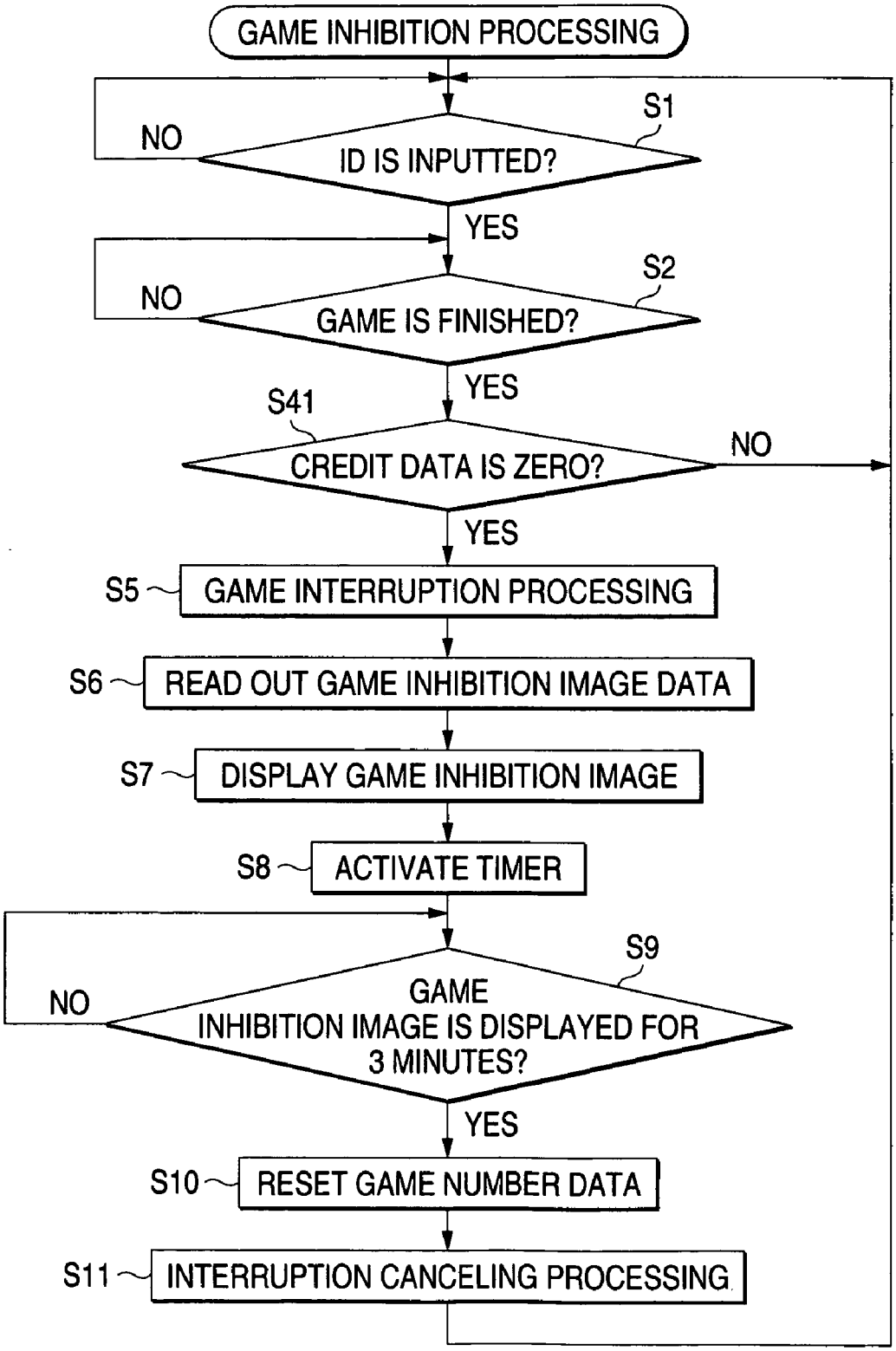
FIG. 7 is a flowchart showing flow of excessive gaming inhibition processing according to a fourth embodiment of the invention.

FIG. 7 is a flowchart showing the flow of excessive gaming inhibition processing according to this embodiment.

As mentioned above, when coins are inserted into the coin insertion slot 5*a* or a bill is inserted into the bill insertion slot 5*b*, the CPU 21 of the main controller 20 causes the unillustrated money counter to count the coins or bill. A result of counting is recorded in the RAM 23 as credit data G. In this embodiment, the player inserts a house card into the card insertion slot 13, and the ID read by the card reader 34 is input to the CPU 21 of the main controller 20 (S1). Every time one round of games is finished (S2), the CPU 21 acts as an inhibition requirement determinant and determines whether or not the credit data recorded in the RAM 23 assume a value of "0" (S41). When having determined that the credit data G assume a value of "0," the CPU 21 performs the gaming interruption processing (S5) and then the gaming inhibition processing (S6), in the same manner as in the case of the first embodiment.

Next will be described a fifth embodiment of the invention in which gaming inhibition processing is performed when a big-payoff combination has hit. The present embodiment is identical with the first embodiment, except that winning of a big-payoff combination is employed as a requirement for inhibiting gaming. Hence, only a feature particular to this embodiment will be described.

Figure 8:
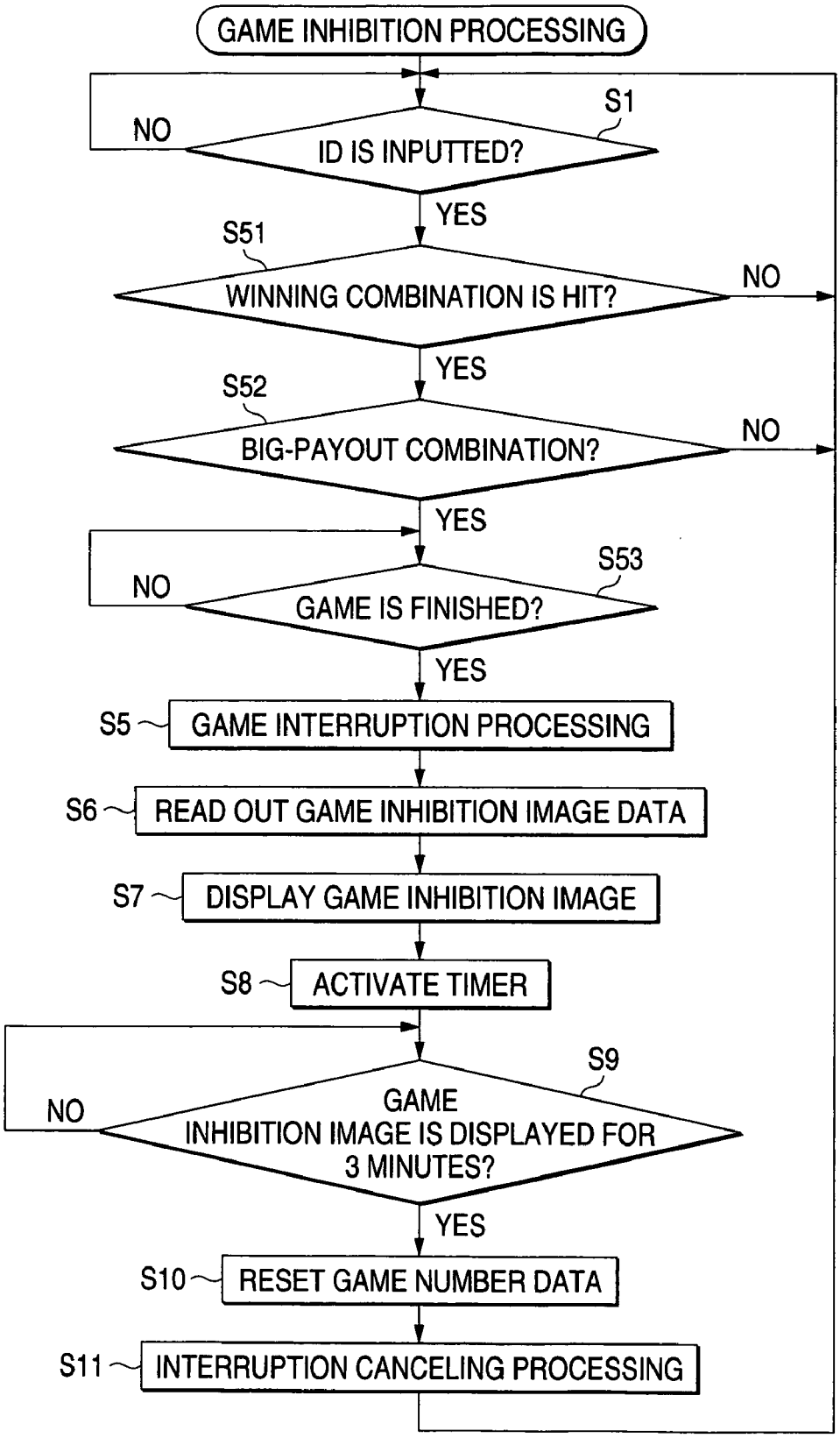
FIG. 8 is a flowchart showing flow of excessive gaming inhibition processing according to a fifth embodiment of the invention.

FIG. 8 is a flowchart showing the flow of excessive gaming inhibition processing according to this embodiment.

As mentioned above, when having determined that a combination involving payoff of a predetermined amount of credit to the player has hit, through the winning determination processing, the CPU 21 of the main controller 20 adds to the credit data recorded in the RAM 23 credits corresponding to the thus-hit combination. In the present embodiment, the player inserts a house card into the card insertion slot 13, and the ID read by the card reader 34 is input to the CPU 21 of the main controller 20 (S1). When a combination has hit after winning determination processing performed during a game (S51), the CPU 21 acts as an inhibition requirement determinant and determines whether or not the thus-hit combination is a predetermined big-payoff combination (S52). The big-payoff combination is a combination involving payoff, to the player, of credits which are greater in amount than a preset specified amount of credits (i.e., a predetermined amount of credit). When having determined that the thus-hit combination is a big-payoff combination, the CPU 21 performs gaming interruption processing (S5) after the current round of game has ended (S53). Then, the CPU 21 performs gaming inhibition processing (S6).

Next will be described a sixth embodiment of the invention in which gaming inhibition processing is performed when a combination for shifting the current round of games to an event or bonus game; i.e., a special game status, or a feature game (hereinafter called an "event combination") has hit, and the event stemming from hitting of the combination has ended. The present embodiment is identical with the first embodiment, except that end of a special game status is employed as a requirement for inhibiting gaming. Hence, only a feature particular to this embodiment will be described.

Figure 9:
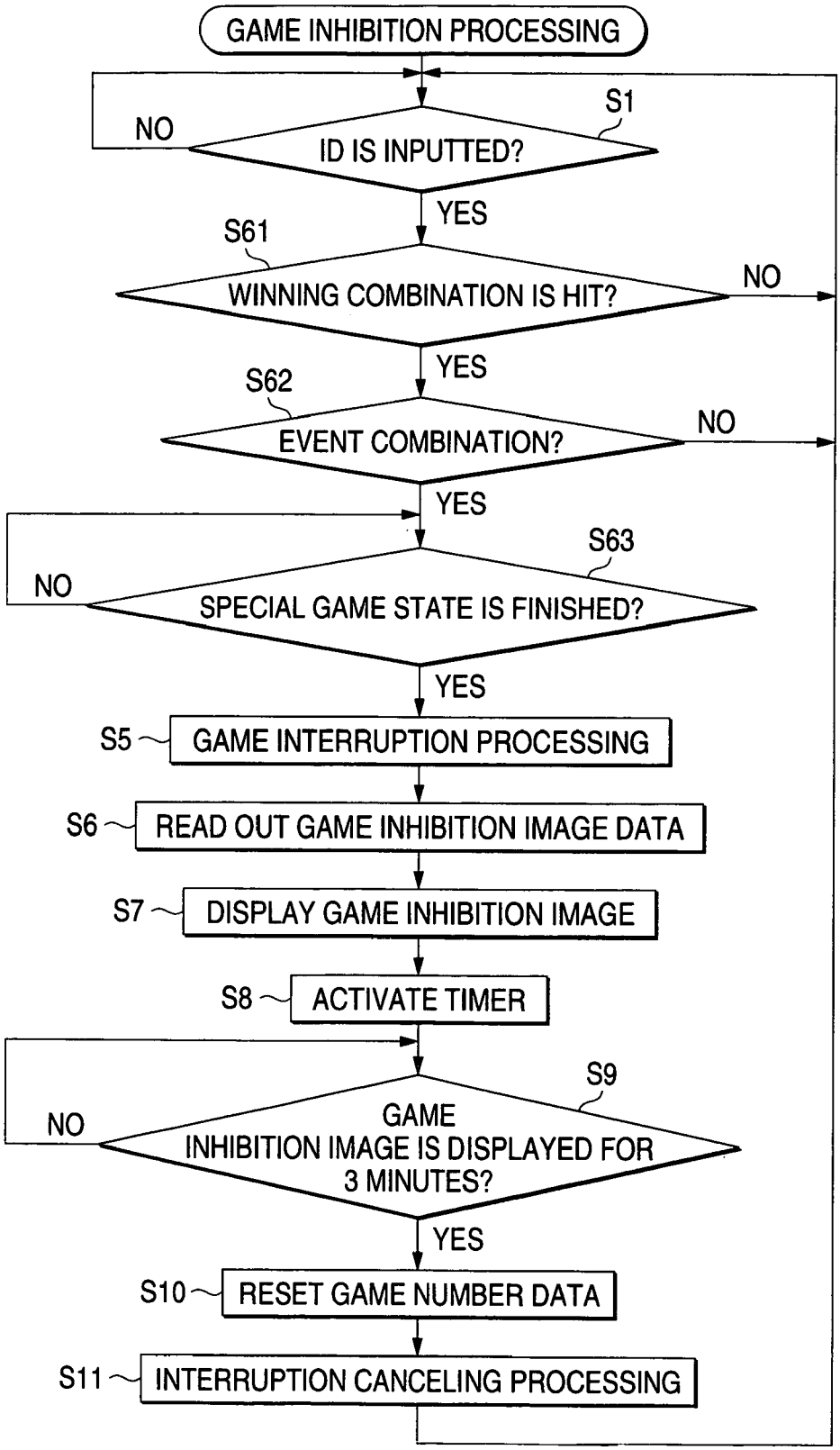
FIG. 9 is a flowchart showing flow of excessive gaming inhibition processing according to a sixth embodiment of the invention.

FIG. 9 is a flowchart showing the flow of excessive gaming inhibition processing according to this embodiment.

As mentioned above, when having determined that there as occurred an event combination involving shift from the current round of games to an event or bonus game; i.e., a special game status, or a feature game, through winning determination processing, the CPU 21 of the main controller 20 causes shift from an ordinary game status to a special game status, such as an event or bonus game corresponding to the kind of the event combination, or a feature game, and proceeds games of the event. In the present modification, the player inserts a house card into the card insertion slot 13, and the ID read by the card reader 34 is input to the CPU 21 of the main controller 20 (S1). When a combination has hit after winning determination processing performed during a game (S61), the CPU 21 determines whether or not the thus-hit combination is an event combination (S62). When having determined that the thus-hit combination is a big-payoff combination, the CPU 21 acts as an inhibition requirement determinant and determines whether or not a special game status stemming from games of the event has ended (S63). If the special game status has ended, gaming interruption processing is performed (S5), and gaming inhibition processing (S6) is performed.

The fifth and sixth embodiments have described a case where gaming inhibition processing is performed when the combination which has hit during the course of gaming played on the slot machine 1 is a big-payoff combination or an event combination. When receiving a wager stemming from a big-payoff combination or event combination, there may be played a gambling game or double-up game for further increasing the wager. Gaming inhibition processing may be performed when the game has ended. When the slot machine 1 is connected to a jackpot system constituted of a plurality of gaming machines, gaming inhibition processing may be effected when the jackpot system has finished payment of a wager.

Next will be described a seventh embodiment of the invention in which gaming inhibition processing is performed when at least one of three gaming inhibition requirements are satisfied. The present embodiment describes a case where three gaming inhibition requirements are employed; that is, a gaming inhibition requirement which is based on the number of games and employed in the first embodiment of the invention; the gaming inhibition requirement which is employed in the fifth embodiment and based on a big-payoff combination; and the gaming inhibition requirement which is employed in the sixth embodiment and based on the event combination.

The present embodiment is identical with the first embodiment, except that a plurality of gaming inhibition requirements are employed. Hence, only a feature particular to this embodiment will be described.

Figure 10:
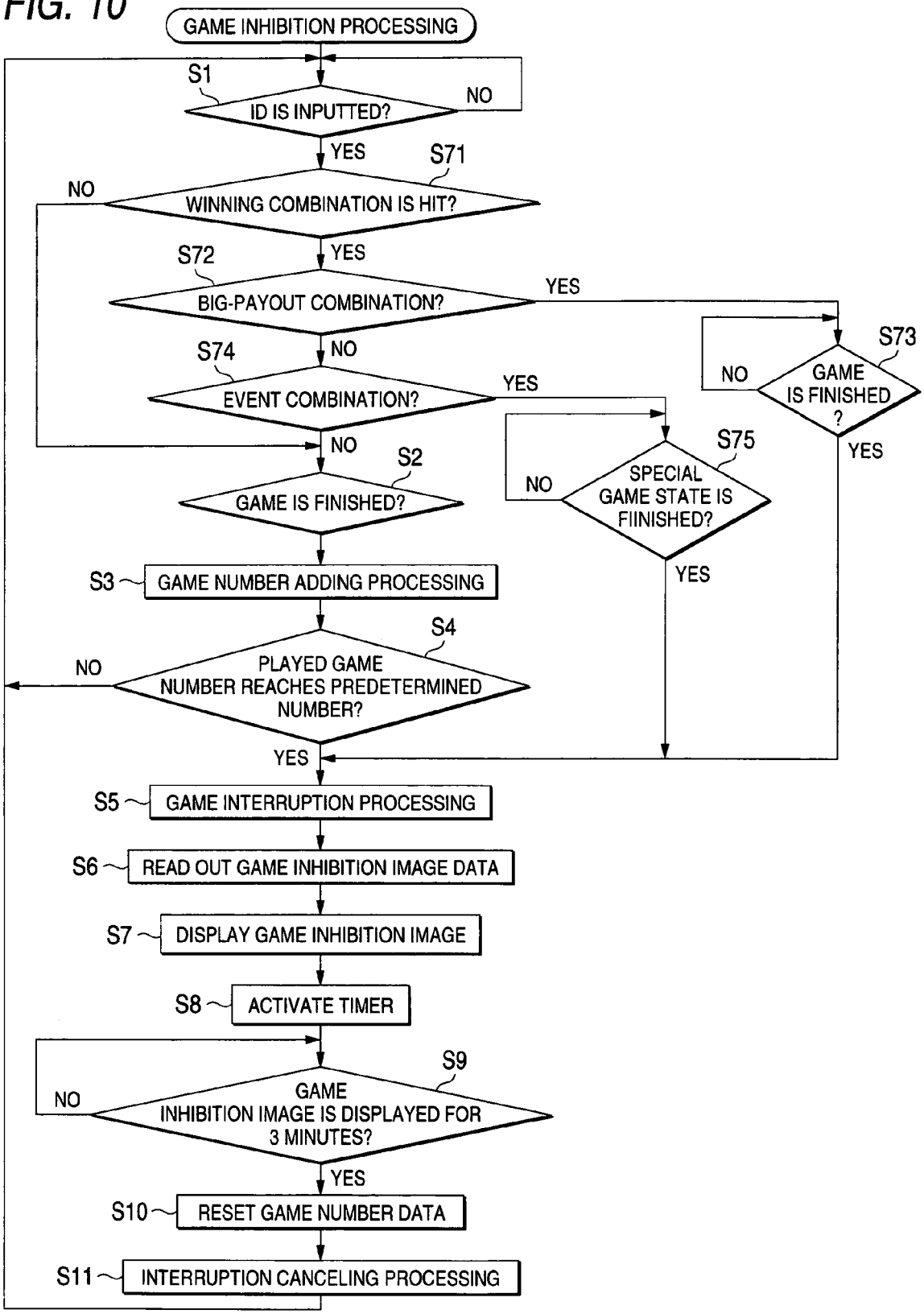
FIG. 10 is a flowchart showing flow of excessive gaming inhibition processing according to a seventh embodiment of the invention.
Figure 11:
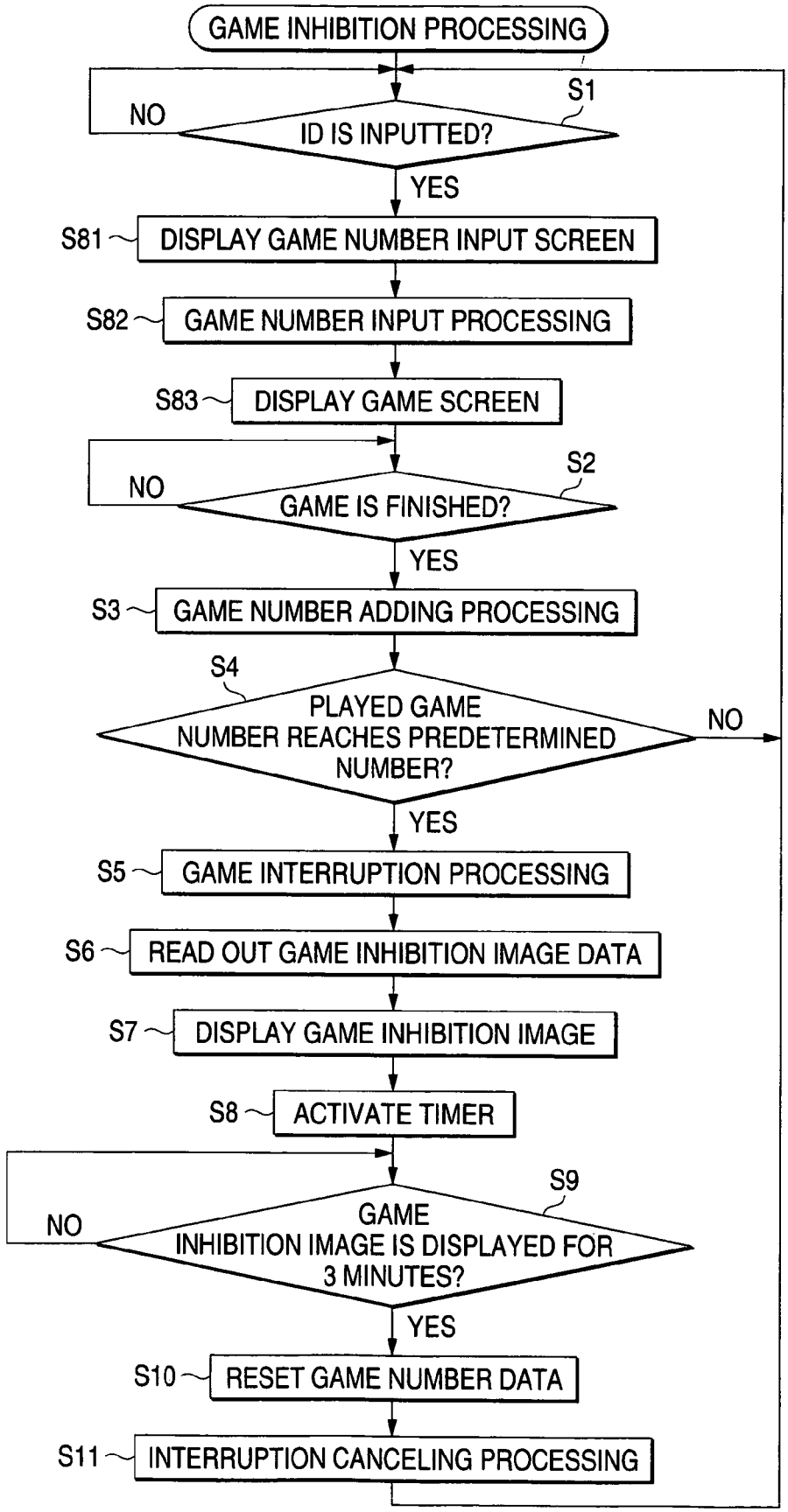
FIG. 11 is a flowchart showing flow of excessive gaming inhibition processing according to an eighth embodiment of the invention.

FIG. 10 is a flowchart showing the flow of excessive gaming inhibition processing according to this embodiment.

Here, the player inserts a house card into the card insertion slot 13, and the ID read by the card reader 34 is input to the CPU 21 of the main controller 20 (S1). The CPU 21 of the main controller 20 determines whether or not a winning has hit after winning determination processing performed during a game (S71). If a winning combination has hit, the CPU 21 determines whether or not the thus-hit combination is a big-payoff combination (S72), as in the case of the fifth embodiment. If the thus-hit combination is determined to be a big-payoff combination, the gaming interruption processing is performed (S5) after the current round of games has ended (S73), and the gaming inhibition processing is performed (S6). In contrast, if in step S72 the hit combination is determined not to be a big-payoff combination, a determination is made as to whether or not the hit combination is an event combination (S74), as in the case of the sixth embodiment. If the hit combination is determined to be an event combination, the gaming interruption processing is performed (S5) after the special game status has ended (S75), and the gaming inhibition processing is performed (S6).

If in step S71 it is determined that no winning combination has hit or that the hit combination is neither a big-payoff combination nor an event combination, the game number addition processing is performed (S3) after the current round of games has ended (S2). A determination is made as to whether or not the number of games A has reached the specified number of games B (S4). If the number of games A is determined to have reached the number of games B, the gaming interruption processing is performed (S5), and the gaming inhibition processing is performed (S6).

In the present embodiment, when the gaming inhibition processing ends (S9) after the hit combination has been determined to be a big-payoff combination or event combination (S72 or S74), the CPU 21 of the main controller 20 acts as a resetter and resets to a value of "0" the game number data which have not yet been determined as a gaming inhibition requirement (S10).

The present modification has employed, in combination, the gaming inhibition requirement employed in the first embodiment, that employed in the fifth embodiment, and that employed in the sixth embodiment. There may be arbitrarily combined the gaming inhibition requirements employed in the respective embodiments. Similarly, there may be employed two gaming inhibition requirements or four or more gaming inhibition requirements.

Next will be described an eighth embodiment of the invention in which the specified number of games B can be set in accordance with a player's desire. The present embodiment is identical with the first embodiment in connection with flow of excessive gaming inhibition processing, except that the specified number of games B can be set in accordance with a player's desire. Hence, only a feature particular to this embodiment will be described.

Here, the player inserts a house card into the card insertion slot 13, and the ID read by the card reader 34 is input to the CPU 21 of the main controller 20 (S1). The CPU 21 outputs to the display controller 25 a display instruction for displaying an input screen which prompts the player to enter the number of games to be played. The display controller 25 performs display control operation for displaying an input screen on the monitor 11, and an input screen appears on the monitor 11 (S81). After having determined the number of games to be played, the player enters a desired number of games in accordance with an input screen by actuating the buttons 6*a*, 6*b*, 7*a*, 7*b*, and 8. The player may enter the number of games directly on the input screen. A plurality of numbers of games may be displayed on the input screen beforehand, and the player may be caused to select one from them. It may be the case that only alternatives, such as "play some games" or "play much," are displayed on the input screen, and the player is caused to select one from them. In this case, the number of games assigned to each of the alternatives may be recorded in the ROM 22, and the CPU 21 ascertains the number of games.

When in step S81 the player presses the play button 6*a* after having finished entering the number of games through the game number input processing, the CPU 21 of the main controller 20 acts as a player information receiver and receives game number data which are player information entered by the player. The CPU 21 records the thus-received game number data into the RAM 23 as a specified number of games B (S82). The CPU 21 outputs, to the display controller 25, a display instruction for switching the screen on the monitor 11 to a game screen including the reel images 11*a*. As a result, the display controller 25 performs a display control operation for causing the monitor 11 to display a game screen, and an ordinary game screen appears on the monitor 11 (S83). Subsequently, the player performs games. Every time one round of games ends (S2), the CPU 21 performs game number addition processing (S3). The CPU 21 then determines whether or not the number of games A pertaining; that is, the game number data acquired through the game number addition processing, has reached the specified number of games B determined by the player (S4). Subsequent processing is the same as that described in the first embodiment.

The first embodiment has been described by reference to a case where gaming interruption processing for interrupting the player's game is performed during the course of gaming inhibition processing being performed when the number of games A has reached the specified number of games B. However, interruption of gaming is not necessarily required. There will now be described a ninth embodiment of the invention which does not involve interruption of gaming. This embodiment is identical with the first embodiment in connection with previous flow of judgment of excessive gaming. Hence, only a feature particular to the eighth modification will be described.

Figure 12:
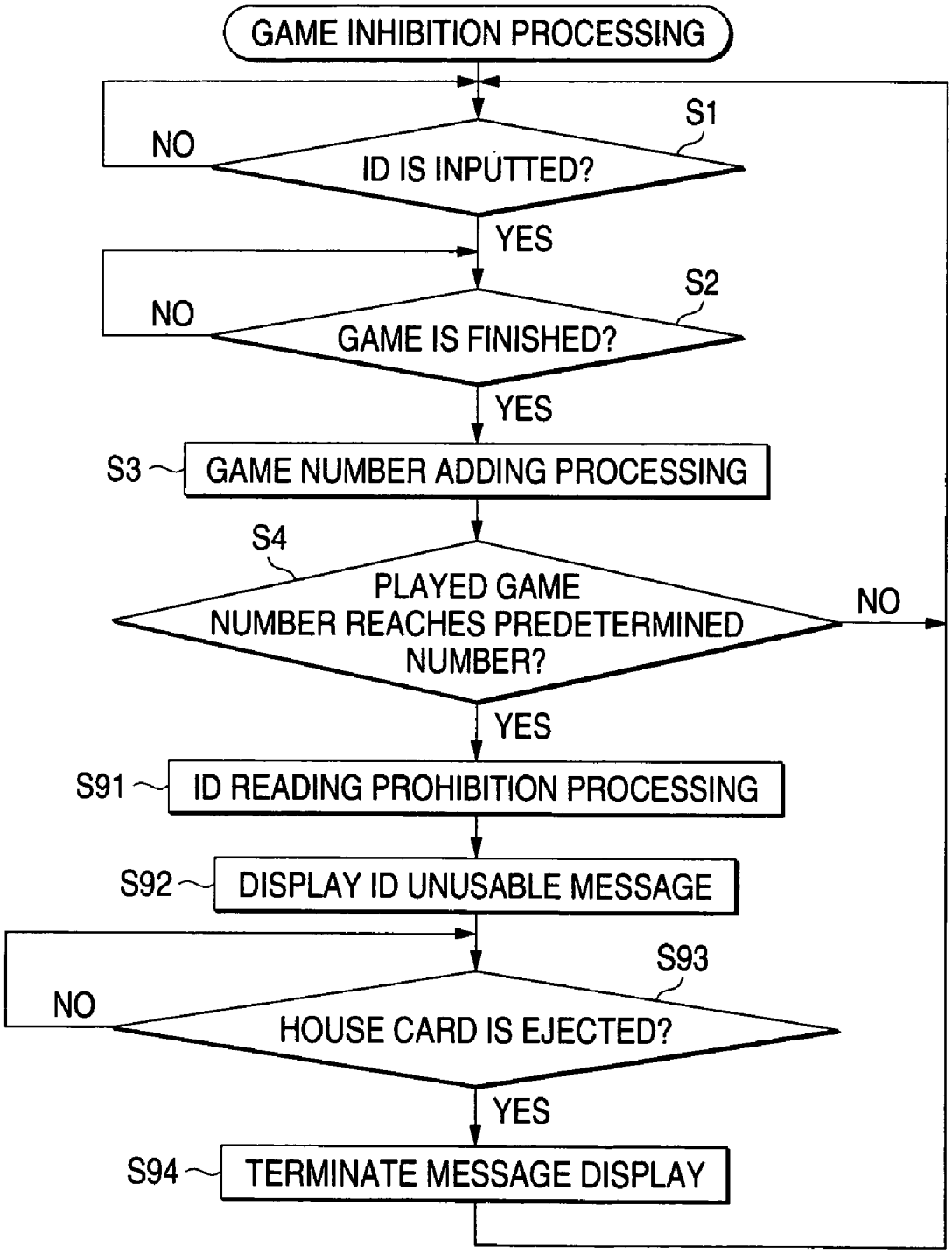
FIG. 12 is a flowchart showing flow of excessive gaming inhibition processing according to a ninth embodiment of the invention.

FIG. 12 is a flowchart showing the flow of excessive gaming inhibition processing according to this embodiment.

Here, the player inserts a house card into the card insert slot 13, and the ID read by the card reader 34 is input to the CPU 21 of the main controller 20 (S1). Every time one round of games is finished (S2), the CPU 21 performs game number addition processing (S3). The CPU 21 then determines whether or not the number of games A pertaining to the game number data acquired through the game number addition processing has achieved the specified number of games B (S4). In the present modification, when the number of games A is determined to have reached the specified number of games B, gaming inhibition processing is performed without gaming interruption processing being performed.

Specifically, when in step S4 the number of games A is determined to have reached the specified number of games B, the CPU 21 of the main controller 20 outputs a read aborting signal to the sub-controller 30 via the I/O port 21*a*. The read aborting signal is input to the CPU 31 via the main controller I/O port 36 of the sub-controller 30. The CPU 31 acts as an ID reading prohibiter and outputs a prohibiting instruction to the card reader 34. As a result, the card reader 34 does not read an ID even when a house card is inserted into the card insert slot 13 (S91).

The CPU 31 of the sub-controller 30 that has received a read aborting signal outputs to the display controller 35 a display instruction for displaying to the player text information stating that the player's house card cannot be used. The display controller 25 performs display control operation for displaying texts based on the display instruction on the display device 14. For example, a message "Your house card cannot be used" appears on the display device 14 (S92). As a result, the player who has finished playing the specified number of games B realizes that the house card cannot be used. The player may be able to continue playing games without utilization of the house card. However, in subsequent games, points are not added to the house card. Hence, it is possible to lead the consciousness of the player toward abandonment of games.

Subsequently, when the player removes the house card from the card insert slot 13, the CPU 31 of the sub-controller 30 determines that the house card has been ejected (S93). Then, the display controller 35 deletes a message appearing on the display device 14 and resumes an ordinary display. In order to prevent the player from re-playing games by utilization of the removed house card, the ID assigned to the player whose number of games A has reached the specified number of games B is preferably recorded on the RAM 23 of the main controller 20. There may be a case where a desire exists for inhibiting the player whose number of games A has reached the specified number of games B on the slot machine 1 from playing games on another gaming machine in the casino. In this case, when the number of games A played by the player has reached the specified number of games B, the ID assigned to the player can be output to the management system 40. The management system 40 gains control over gaming machines connected to the management system 40 and can render the ID unusable.

The first embodiment has been described by reference to a case where the gaming interruption is canceled after the gaming inhibition image is displayed for three minutes. There will now be described a tenth embodiment in which the gaming interruption cannot be canceled without a casino attendant's operation. The present embodiment is identical with the first embodiment in connection with flow of excessive gaming inhibition processing, except that the way of canceling the gaming interruption. Hence, only a feature particular to this embodiment will be described.

Figure 13:
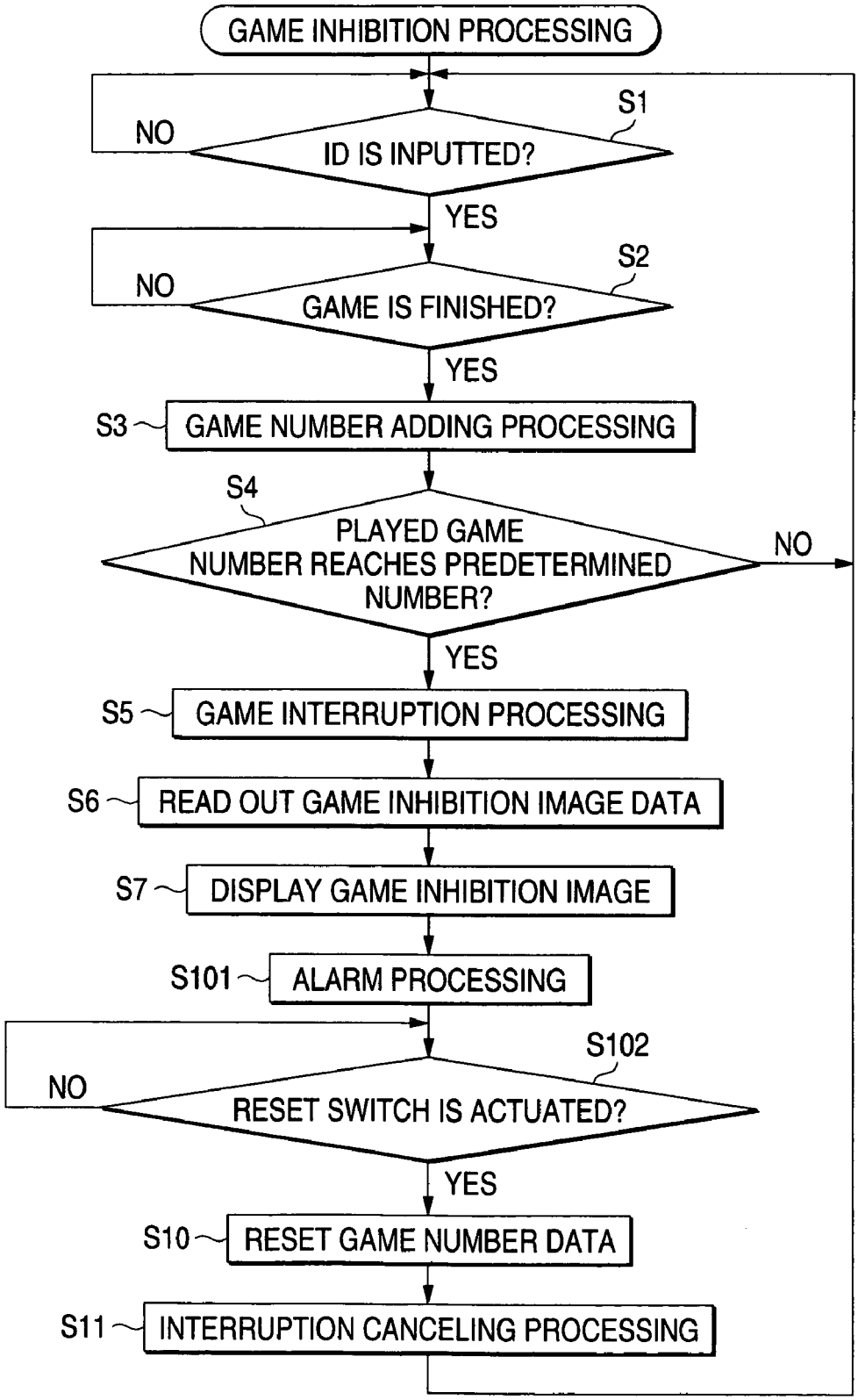
FIG. 13 is a flowchart showing flow of excessive gaming inhibition processing according to a tenth embodiment of the invention.

FIG. 13 is a flowchart showing the flow of excessive gaming inhibition processing according to this embodiment.

Here, when the number of games A reaches the specified number of games B (S4), gaming interruption processing is performed (S5). Subsequently, the display controller 25 displays a gaming inhibition screen on the monitor 11 in place of the reel images 11*a* (S7). In the present modification, there is performed report processing for informing an attendant that the number of games A played by the player has reached the specified number of games B (S101).

Through the report processing, the CPU 21 of the main controller 20 outputs to the sound controller 27 a sound output instruction for providing an announcement stating that the number of games A played by the player has reached the specified number of games B, in the form of sound information. As a result, the sound controller 27 controls the speaker 15, to thereby output the announcement based on the sound output instruction in the form of voice. Upon listening to the announcement, the player of the slot machine 1 realizes that the number of games A played has reached the specified number of games B. Here, in conjunction with voice announcement or in place of voice announcement, for example, special lamps may be illuminated; a predetermined signal may be output to a radio held by an attendant; and a predetermined signal may be output to the management system 40, whereupon the management system informs an attendant that the player of the slot machine 1 has reached the specified number of games B.

The attendant who has received the announcement inserts a special key into the reset switch 12 provided on the side face of the slot machine 1 and turns the key. When the reset switch 12 is actuated in this way (S102), the CPU 21 of the main controller 20 resets the game number data recorded in the RAM 23 to a value of "0" (S10), thus performing interruption canceling processing (S11).

The present embodiment has described a case where interruption of gaming is cancelled by an attendant actuating the reset switch 12. However, the slot machine 1 may be constructed such that the player can cancel interruption for himself. For example, when the player actuates one of the other operation buttons 8 while a gaming inhibition image is appearing on the screen, the CPU 21 receives the operation signal and resets the game number data recorded in the RAM 23 to a value of "0" (S10), thus performing interruption canceling processing (S11).

There will now be described an eleventh embodiment of the invention. The present embodiment is identical with the first embodiment, except that a currently-televised TV broadcast is displayed in place of the gaming inhibition image based on the gaming inhibition data recorded on the ROM 22 of the main controller 20. Hence, only a feature particular to the second embodiment will be described.

Figure 14:
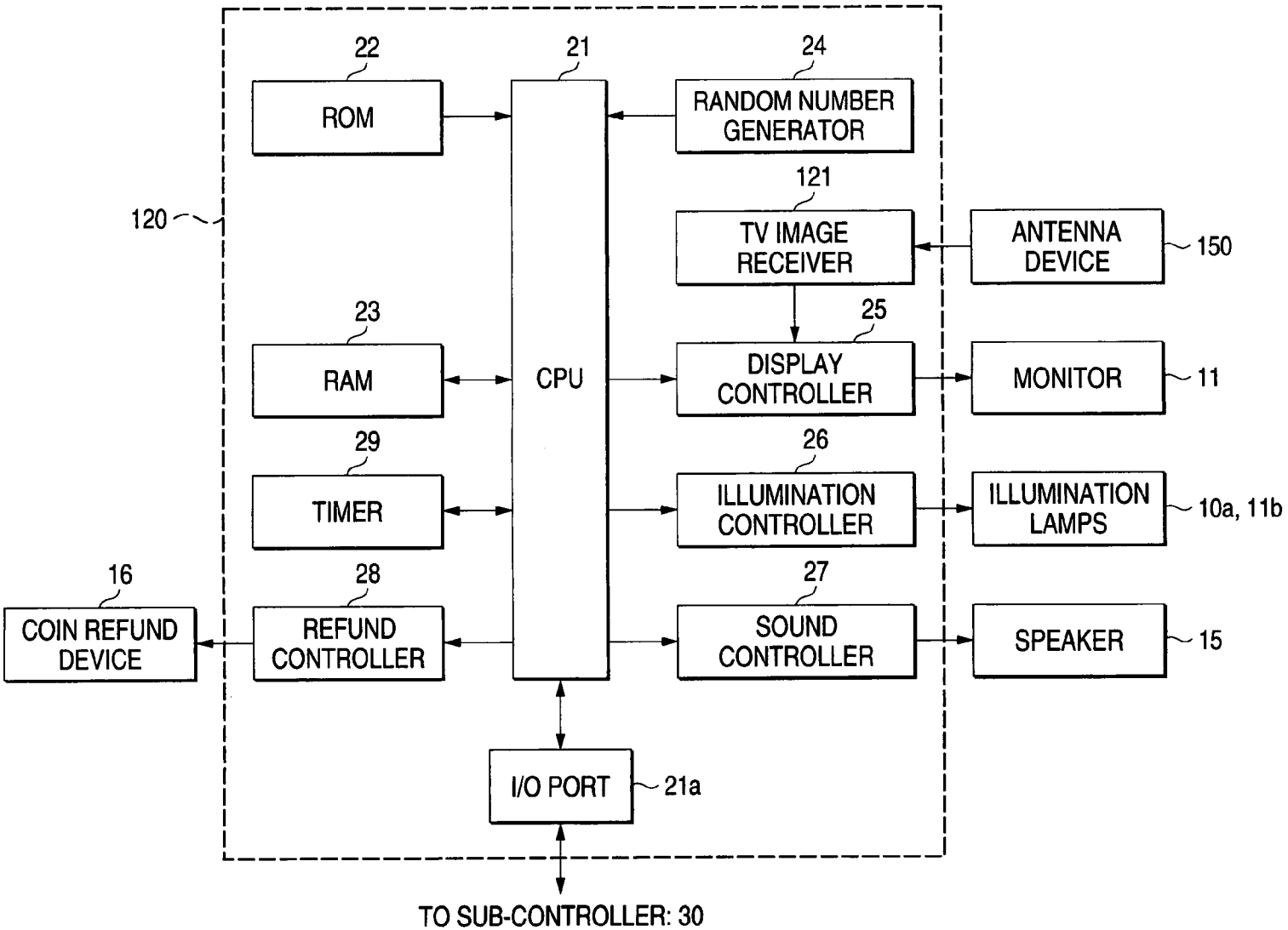
FIG. 14 is a block diagram schematically showing the configuration of a main controller of a slot machine according to an eleventh embodiment of the invention.

FIG. 14 is a block diagram schematically showing the configuration of a main controller of a slot machine according to this embodiment. The sub-controller 30 is identical with that described in connection with the first embodiment. In addition to the configuration of the main controller 20 according to the first embodiment, the main controller 120 according to the present embodiment has a TV image receiver 121 for receiving TV image information about TV broadcast. The main controller 120 is connected to the display controller 25. Further, the TV image receiver 121 is also connected to an antenna unit 150 which is provided outside the slot machine 1 and receives a TV radio wave. The antenna unit 150 sends TV image information included in the received radio waves to the TV image receiver 121. The TV image receiver 121 sends the TV image information to the display controller 25. In accordance with control of the CPU 21, the display controller 25 can display TV images on the monitor 11 on the basis of the TV image information received from the TV image receiver 121.

Figure 15:
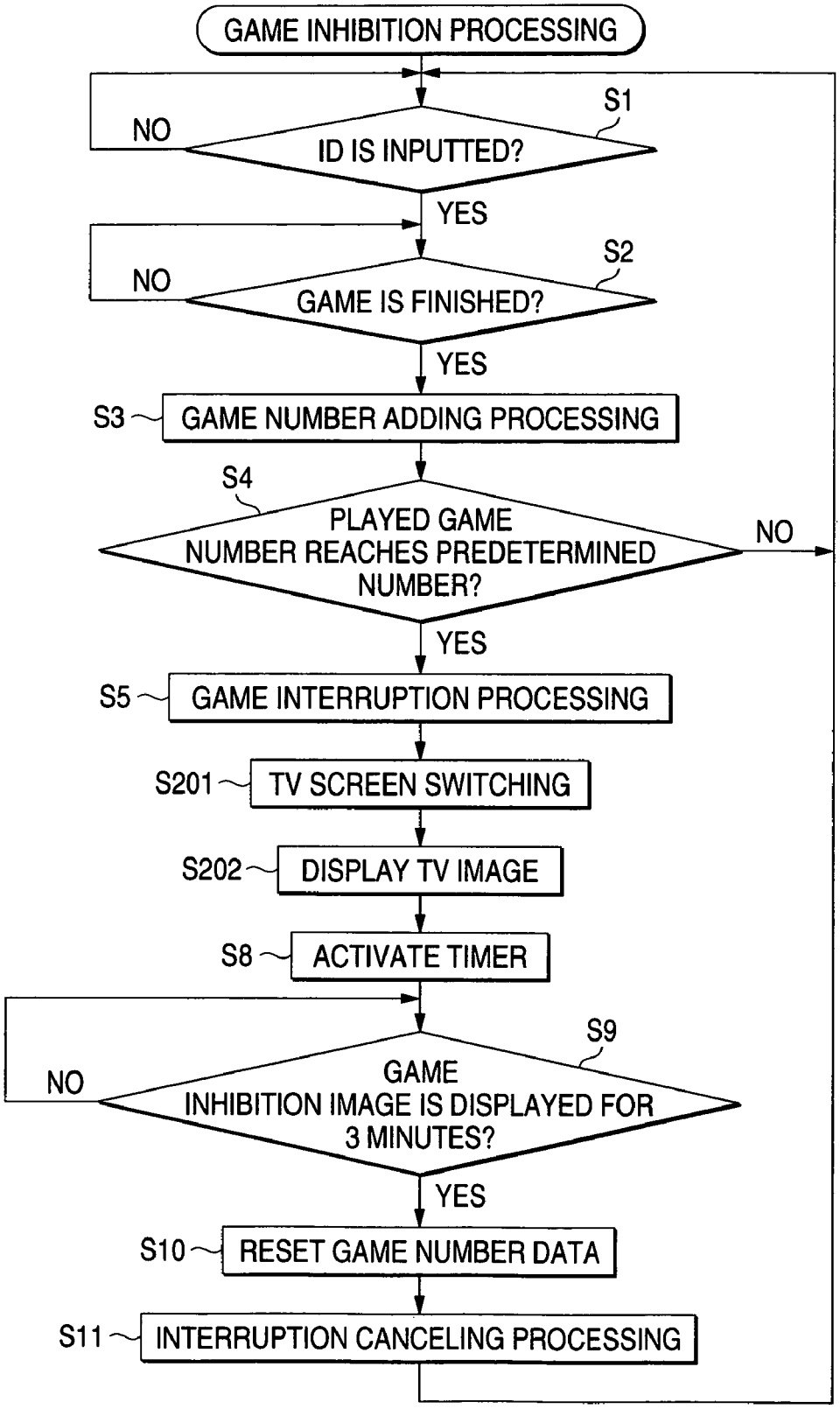
FIG. 15 is a flowchart showing flow of excessive gaming inhibition processing to be performed in the slot machine of FIG. 14.

FIG. 15 is a flowchart showing the flow of excessive gaming inhibition processing according to this embodiment. As in the case of the first embodiment, after the number of games A has been determined to have reached the specified number of games B (S4) gaming interruption processing is performed (S5). Subsequently, the CPU 21 outputs, to the display controller 25, a display changeover instruction for switching the display on the monitor 11 from game images, such as the reel images 11*a,* to a TV image. Upon receiving the display changeover instruction, the display controller 25 performs display control operation for displaying, on the monitor 11, a TV image based on the TV image information received from the TV image receiver 121 (S201). As a result, a TV image currently being broadcast appears on the monitor 11 (S202). Subsequently, the timer 29 measures a display time period (S8 and S9). When three minutes have elapsed, the game number data are reset (S10), thus canceling interruption of gaming (S11).

The eleventh embodiment has described a case where the slot machine 1 is connected directly to the antenna unit 150. However, in a casino where a plurality of slot machines 1 are installed, the slot machine 1 may be constructed such that the antenna unit 150 is connected to the management system 40 and such that the management system 40 distributes TV image information to the slot machines 1.

There will now be described a twelfth embodiment of the invention in which the present invention is applied to the same slot machine as that described in connection with the first embodiment. The present embodiment is identical with the first embodiment, except that the gaming activity of a player is informed to an acquaintance through the gaming inhibition processing instead of a gaming inhibition image being displayed. Hence, only a feature particular to this embodiment will be described.

Figure 16:
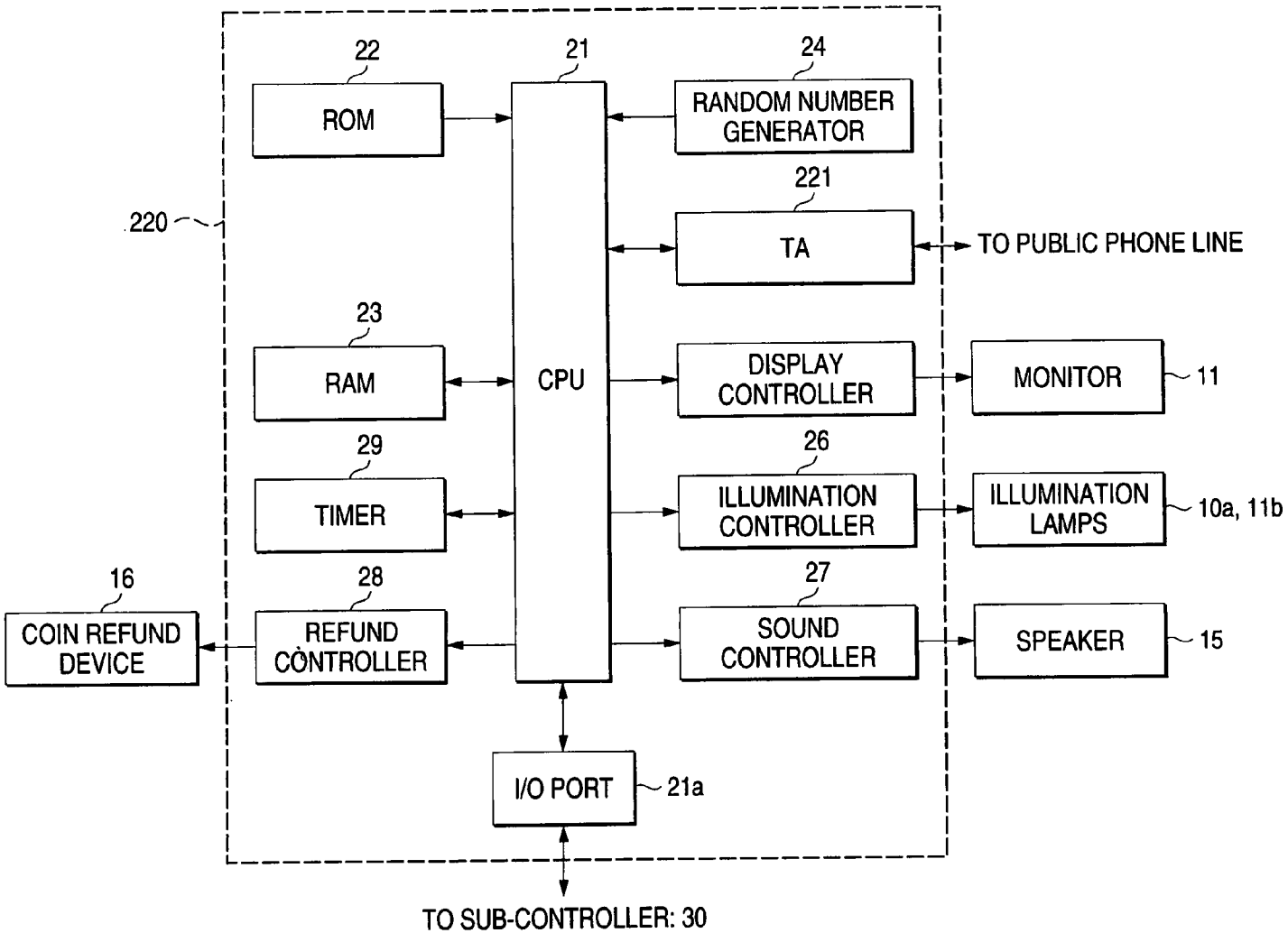
FIG. 16 is a block diagram schematically showing the configuration of a main controller of a slot machine according to a twelfth embodiment of the invention.

FIG. 16 is a block diagram schematically showing the configuration of a main controller of the slot machine 1 according to this embodiment. The sub-controller 30 is identical with that described in connection with the first embodiment. In addition to the configuration of the main controller according to the first embodiment, a main controller 220 is provided with a terminal adapter 221 (hereinafter abbreviated as "TA" ) serving as a phone call conductor connected to a public phone line. The CPU 21 can communicate sound information via the TA 221.

Figure 17:
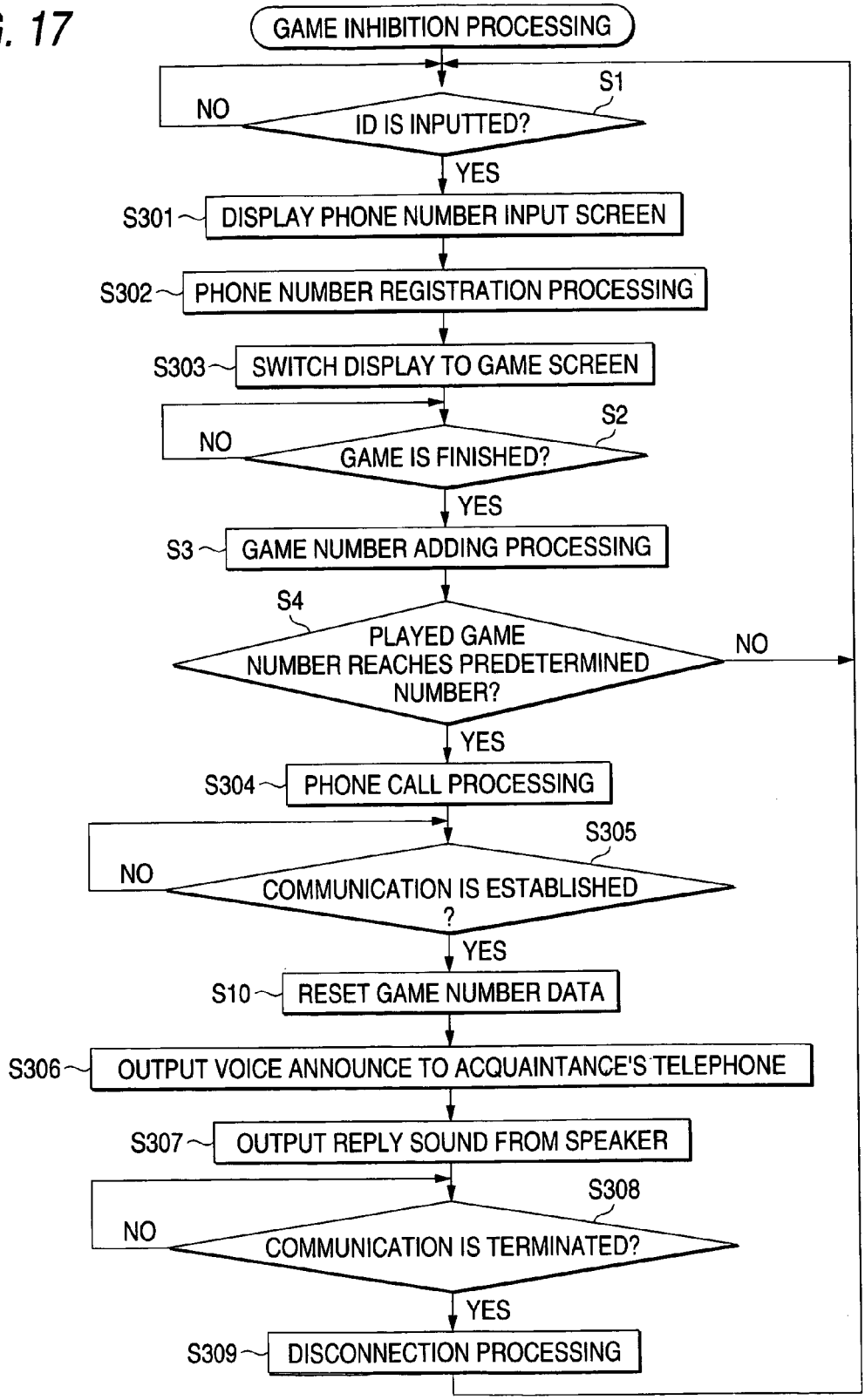
FIG. 17 is a flowchart showing flow of excessive gaming inhibition processing to be performed in the slot machine of FIG. 15.

FIG. 17 is a flowchart showing the flow of excessive gaming inhibition processing according to this embodiment.

Here, the player inserts a house card into the card insert slot 13, and the ID read by the card reader 34 is input to the CPU 21 of the main controller 20 (S1). The CPU 21 outputs, to the display controller 25, a display instruction for displaying an input screen for prompting the player to enter the phone number of his/her acquaintance. The display controller 25 performs display control operation for displaying an input screen on the monitor 11, and an input screen appears on the monitor 11 (S301). At this time, preferably the player enters the phone number of a member of his/her family or an acquaintance who will attempt to persuade the player to abandon gaming when the player has excessively indulged in games.

In accordance with an input screen, the player actuates the buttons 6*a,* 6*b,* 7*a,* 7*b,* and 8, thereby entering a phone number of the player's acquaintance. The slot machine 1 is provided with an input device, such as a ten-key, to be used for entering a phone number. The slot machine 1 may cause a player to enter a phone number by actuating the input device.

When in step S301 the player presses the play button 6a after having finished entering a phone number through the phone number input processing, the CPU 21 of the main controller 220 acts as a phone number register and receives a phone number entered by the player. The CPU 21 records the thus-received phone number into the RAM 23 (S302).

In order to switch a screen on the monitor 11 to a game screen including the reel images 11*a,* the CPU 21 outputs a display instruction to the display controller 25. The display controller 25 performs display control operation for displaying a game screen on the monitor 11, whereupon a normal play screen appears on the monitor 11 (S303). Subsequently, the player plays games. Every time one round of games is finished (S2), the CPU 21 performs game number addition processing (S3).

When it is determined that the number of games A has reached the specified number of games B (S4), the CPU 21 performs communication processing through use of the TA 221 (S304) without performing the gaming interruption processing. The CPU 21 reads a phone number recorded in the RAM 23 through communication processing, and a phone call is made at the phone number through use of the TA 221.

Through the communication processing, a phone call is established with the player's acquaintance, and communication is established with the phone of the acquaintance (S305). At this time, the CPU 21 acts as a sound information provider and outputs, to the TA 221, voice announcement which is voice information stored in the ROM 22 (S306). The voice announcement is delivered to the acquaintance's phone via the TA 221, and the acquaintance can listen to the voice announcement. Here, for example, there is output a voice announcement "Your friend is playing games in our casino. After the tone, please persuade him/her to stop playing."

The voice output by the acquaintance who has heard the announcement after a dialing tone is input to the CPU 21 of the main controller 20. The CPU 21 delivers the sound information input by the acquaintance to the sound controller 27, where the information is output from the speaker 15 (S307). The acquaintance can persuade the player playing on the slot machine 1 by voice from his/her own phone.

Here, the name of the player is acquired from the management system 40 by reference to an ID. Preferably, voice is synthesized such that the voice announcement includes the name. Hence, the name of the player can be informed to the acquaintance. Subsequently, when the acquaintance hangs up and the phone has become a non-communication state (S308), the CPU 21 performs disconnection processing (S309).

The present embodiment has described a method of informing the player's gaming activity to his/her acquaintance by phone. However, the player's gaming activity can be reported to his/her acquaintance by another method. For instance, instead of the entry of an acquaintance's phone number through the input processing in step S301, an acquaintance's E-mail address which is address information may be input, and the player's activity may be informed to the acquaintance by E-mail. Alternatively, an E-mail address or any information which identifies an individual may be posted on a web site of the casino, thus enabling acquaintances of the player to access the player.

In this case, the CPU 21 of the main controller 220 acts not as the phone number register but as an address information register, as well as acting not as the sound information provider but as a text information provider. The TA 221 acts not as the phone call conductor but as an information communicator. At this time, in order to improve the security of personal information, there may be requested entry of a password to access a mail server or a WEB server.

Alternatively, in addition to the entry of an acquaintance's phone number or an E-mail address, time information at which the player should abandon the gaming may be input. When a predetermined requirement in connection with the registered time information, the above telephonic communication processing or the E-mail transmission processing is effected. In this configuration, the player would not continue playing games while forgetting scheduled activities or canceling the activities.

The embodiments and modifications have been described by taking, as an example, the slot machine 1 installed in a casino. However, the present invention is not limited to such an example. The present invention can be applied to a variety of gaming machines, such as slingshot machines or slot machines installed in parlors, arcade gaming machines to be installed in amusement arcades, and home TV game machines.

The embodiments and modifications have described the cases where sound information, such as gaming inhibition image data and sound announcement, and data to be used in gaming inhibition processing are stored in the ROM 22 and where the data are employed. Data recorded on a recording medium, such as a hard disk, a CD-ROM, a DVD, or a magnetic tape, may also be utilized. In this case, the recording medium does not need to be provided in the slot machine 1. For instance, the recording medium may be provided in the management system 40 so as to be utilized by way of the communications system.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A gaming machine, comprising:

operating members, adapted to be actuated by a player;

a game processor, which executes a game in accordance with the actuation of the operating members;

an inhibition requirement determinant, which determines whether a predetermined inhibition requirement is satisfied while the game processor executes the game;

a game inhibiter, which performs game inhibition processing for diverting an attention of the player toward something other than the game without interrupting the game executed by the game processor, from when the inhibition requirement determinant determines that the inhibition requirement is satisfied and until when a cancel requirement for canceling the game inhibition processing is satisfied; and an ID reader, which is operable to read out ID information of the player from a portable recording medium possessed by the player, wherein the game inhibiter prohibits the ID reader to read out the ID information until when the cancel requirement is satisfied.

2. The gaming machine as set forth in claim 1, wherein the game inhibition processing is performed while the game processor executes the game.

3. The gaming machine as set forth in claim 1, further comprising a presentation provider, which is activated by the game inhibition processing to provide a presentation for diverting the player's attention.

4. The gaming machine as set forth in claim 1, further comprising a display device, which displays a gaming image showing the game executed by the game processor, wherein the game inhibiter provides an inhibition image on the display device as the game inhibition processing.

5. The gaming machine as set forth in claim 4, further comprising an image information storage, which stores images to be displayed as the inhibition image.

6. The gaming machine as set forth in claim 4, further comprising an image information receiver, which receives an externally provided image to be displayed as the inhibition image.

7. The gaming machine as set forth in claim 1, wherein the game inhibiter provides an alarm as the game inhibition processing.

8. The gaming machine as set forth in claim 7, wherein the alarm includes a visual message.

9. The gaming machine as set forth in claim 7, wherein the alarm includes a sound.

10. The gaming machine as set forth in claim 1, further comprising a phone number register, which registers a phone number assigned to a person who is other than the player, wherein the game inhibiter establishes a connection to a telephone having the registered phone number as the game inhibition processing.

11. The gaming machine as set forth in claim 10, wherein the game inhibiter generates sounds provided from the telephone.

12. The gaming machine as set forth in claim 10, further comprising an time information register, which registers lime information indicating a time at which the player abandoned the game, the time information constituting the inhibition requirement.

13. The gaming machine as set forth in claim 1, further comprising an address information register, which registers address information assigned to a person who is other than the player, wherein the game inhibiter transmits information regarding a gaming condition of the player to a communication device associated with the address information, as the game inhibition processing.

14. The gaming machine as set forth in claim 13, further comprising an time information register, which registers time information indicating a time at which the player abandon the game, the time information constituting the inhibition requirement.

15. The gaming machine as set forth in claim 1, further comprising a canceller, which cancels the game inhibition processing.

16. The gaming machine as set forth in claim 1, further comprising a game number counter, which counts a number of game executed by the game processor from a predetermined time point, wherein the inhibition requirement is satisfied when the number counted by the game number counter reaches a predetermined number.

17. The gaming machine as set forth in claim 1, further comprising a timer which measures a time period from a predetermined time point, wherein the inhibition requirement is satisfied when the time period measured by the timer reaches a predetermined time period.

18. The gaming machine as set forth in claim 1, further comprising:

a gaming value accepter, which accepts a gaming value from a player; and a gaming value counter, which counts an amount of gaming value accepted by the gaming value accepter, from a predetermined time point, wherein the inhibition requirement is satisfied when the amount of gaming value counted by the gaming value counter reaches a predetermined amount.

19. The gaming machine as set forth in claim 1, further comprising:

a gaming value accepter, which accepts a gaming value from a player; and a gaming value storage, which stores an amount of gaming value accepted by the gaming value accepter, wherein the inhibition requirement is satisfied when the stored amount of gaming value is consumed in the game.

20. The gaming machine as set forth in claim 1, further comprising a payout provider, which provides a payout to the player, the payout being a gaming value corresponding to a result of the game, wherein the inhibition requirement is satisfied when an amount of the payout at one unit of the game reaches a predetermined amount.

21. The gaming machine as set forth in claim 1, wherein:

the inhibition requirement includes a plurality of sub-requirements; and the game inhibiter performs the game inhibition processing when at least one of the sub-requirements is satisfied.

22. The gaming machine as set forth in claim 21, further comprising a resetter, which resets at least one of conditions associated with the respective sub-requirements when the at least one of the sub-requirements is satisfied.

23. The gaming machine as set forth in claim 1, wherein the inhibition requirement is determined in accordance with information which is externally input by the player.

24. A method of inhibiting a player to excessively play a game performed in a gaming machine, comprising the steps of:

executing the game on the gaming machine;

determining whether a predetermined inhibition requirement is satisfied while the game is executed;

diverting an attention of the player toward something other than the game without interrupting the game executed by the game processor, from when the inhibition requirement is satisfied, and until when a cancel requirement for canceling the game inhibition processing is satisfied; and prohibiting an ID reader to read out ID information of the player from a portable recording medium possessed by the player until when the cancel requirement is satisfied.

25. The game inhibition method as set forth in claim 24, wherein:

the game executing step includes a step of displaying a gaming image on a display device; and the attention diverting step includes a step of displaying an inhibition image on the display device.

26. The game inhibition method as set forth in claim 25, further comprising the steps of:

storing images in an image information storage; and reading out an image to be displayed as the inhibition image from the image information storage.

27. The game inhibition method as set forth in claim 25, further comprising the step of receiving an externally provided image to be displayed as the inhibition image.

28. The game inhibition method as set forth in claim 24, wherein the attention diverting step includes the step of providing an alarm.

29. The game inhibition method as set forth in claim 28, wherein the alarm includes a visual message.

30. The game inhibition method as set forth in claim 28, wherein the alarm includes a sound.

31. The game inhibition method as set forth in claim 24, further comprising the step of registering a phone number assigned to a person who is other than the player, wherein the attention diverting step includes the step of establishing a connection to a telephone having the registered phone number as the game inhibition processing.

32. The game inhibition method as set forth in claim 31, wherein the attention diverting step includes the step of generating sounds provided from the telephone.

33. The game inhibition method as set forth in claim 31, further comprising the step of registering time information indicating a time at which the player abandoned the game, the time information constituting the inhibition requirement.

34. The game inhibition method as set forth in claim 24, further comprising the step of registering address information assigned to a person who is other than the player, wherein the attention diverting step includes the step of transmitting information regarding a gaming condition of the player to a communication device associated with the address information.

35. The game inhibition method as set forth in claim 34, further comprising the step of registering time information indicating a time at which the player abandoned the game, the time information constituting the inhibition requirement.

36. The game inhibition method as set forth in claim 24, further comprising the step of counting a number of games executed by the game processor from a predetermined time point, wherein the inhibition requirement is satisfied when the counted reaches a predetermined number.

37. The game inhibition method as set forth in claim 24, further comprising the step of measuring a time period from a predetermined time point, wherein the inhibition requirement is satisfied when the measured time period reaches a predetermined time period.

38. The game inhibition method as set forth in claim 24, further comprising the steps of:

accepting a gaming value from a player; and counting an amount of gaming value accepted by the gaming value accepter, from a predetermined time point, wherein the inhibition requirement is satisfied when the counted amount of gaming value reaches a predetermined amount.

39. The game inhibition method as set forth in claim 24, further comprising the steps of:

accepting a gaming value from a player; and storing the accepted amount of gaming value, wherein the inhibition requirement is satisfied when the stored amount of gaming value is consumed in the game.

40. The game inhibition method as set forth in claim 24, further comprising the step of providing a payout to the player, the payout being a gaming value corresponding to a result of the game, wherein the inhibition requirement is satisfied when an amount of the payout at one unit of the game reaches a predetermined amount.

41. The game inhibition method as set forth in claim 24, wherein:

the inhibition requirement includes a plurality of sub-requirements; and the attention diverting step is performed when at least one of the sub-requirements is satisfied.

42. The game inhibition method as set forth in claim 41, further comprising the step of resetting at least one of conditions associated with the respective sub-requirements, when the at least one of the sub-requirements is satisfied.

43. The game inhibition method as set forth in claim 24, further comprising the step of determining the inhibition requirement in accordance with information which is externally input by the player.

44. A storage medium containing a program for causing a computer to execute the game inhibition method as set forth in any one of claims 26–37 and 36–40 and 41–43.

* * * * *